US012472547B2

(12) United States Patent
Ghosh et al.

(10) Patent No.: US 12,472,547 B2
(45) Date of Patent: Nov. 18, 2025

(54) STRAP-WINDING AND STRAP-COIL-DEFORMING SYSTEM

(71) Applicant: Signode India Ltd., Hyderabad (IN)

(72) Inventors: Sanjoy Ghosh, Hyderabad (IN); Srungari Ramu, Hyderabad (IN)

(73) Assignee: Signode India Limited, Hyderabad (IN)

( * ) Notice: Subject to any disclaimer, the term of this patent is extended or adjusted under 35 U.S.C. 154(b) by 178 days.

(21) Appl. No.: 18/043,998

(22) PCT Filed: Sep. 10, 2021

(86) PCT No.: PCT/IN2021/050885

§ 371 (c)(1),
(2) Date: Mar. 3, 2023

(87) PCT Pub. No.: WO2022/054092

PCT Pub. Date: Mar. 17, 2022

(65) Prior Publication Data

US 2024/0278305 A1 Aug. 22, 2024

(30) Foreign Application Priority Data

Sep. 11, 2020 (IN) ..... 202041039444

(51) Int. Cl.

| | |
|---|---|
| ***B21C 47/26*** | (2006.01) |
| ***B65H 54/52*** | (2006.01) |
| ***B65H 54/80*** | (2006.01) |

(52) U.S. Cl.

CPC ..... *B21C 47/26* (2013.01); *B21C 47/267* (2013.01); *B65H 54/52* (2013.01); *B65H 54/80* (2013.01)

(58) Field of Classification Search

CPC ..... B21C 47/26; B21C 47/267; B65H 54/52; B65H 54/80; B65H 54/84

See application file for complete search history.

(56) References Cited

U.S. PATENT DOCUMENTS 3,698,223 A 10/1972 Sagara
4,437,223 A 3/1984 Petros
(Continued)

FOREIGN PATENT DOCUMENTS

DE 2411147 A1 * 10/1975 ..... B21C 47/24
DE 10247586 A1 * 5/2003 ..... B21C 47/04
(Continued)

OTHER PUBLICATIONS

"International Search Report and Written Opinion", corresponding PCT Application No. PCT/IN2021/050885, Dec. 6, 2021.
(Continued)

*Primary Examiner* — Christopher L Templeton
*Assistant Examiner* — Matthew Stephens
(74) *Attorney, Agent, or Firm* — Neal, Gerber & Eisenberg LLP

(57) ABSTRACT

Various embodiments of the present disclosure provide a strap-winding and strap-coil-deforming system (10) configured to wind a strap segment (S) into a coil and then deform the strap coil to render it more compact and to reduce the likelihood that it will uncoil during handling, storage, or transport. The deformed strap coil is introduced into a discharge chute (DC) to discharge it away from the strap-winding and strap-coil-deforming system (10) for further handling, storage, or transport.

20 Claims, 27 Drawing Sheets

(56) References Cited

U.S. PATENT DOCUMENTS

| | | | |
|---|---|---|---|
| 7,832,246 | B2 | 11/2010 | Spaans et al. |
| 2006/0000939 | A1 | 1/2006 | Kudrus |

FOREIGN PATENT DOCUMENTS

| | | | | | |
|---|---|---|---|---|---|
| EP | 1640273 | A1 * | 3/2006 | ..... | B21C 47/04 |
| EP | 1991376 | A1 | 11/2008 | | |
| EP | 2910508 | A1 | 8/2015 | | |
| GB | 1339147 | A | 11/1973 | | |
| GB | 2023532 | A | 1/1980 | | |
| JP | S63212098 | A | 9/1988 | | |
| KR | 100797294 | B1 * | 1/2008 | ..... | B21C 47/24 |

OTHER PUBLICATIONS

First Examination Report, from corresponding Indian Patent Application No. 202347014990, Apr. 28, 2023.

* cited by examiner

STRAP-WINDING AND STRAP-COIL-DEFORMING SYSTEM

PRIORITY CLAIM

This is a national phase application of PCT/IN2021/050885, filed on Sep. 10, 2021, which claims priority to and the benefit of India Patent Application No. 202041039444, filed Sep. 11, 2020, the entire contents of which are incorporated herein by reference.

FIELD

The present disclosure relates to strap-winding and strap-coil-deforming systems.

BACKGROUND

Steel, aluminum, and other metals are manufactured into (relatively) thin sheets that are wound into large, heavy coils for storage and (later) transport to customers. To prevent one of these metal coils from uncoiling, its manufacturer typically applies several segments of steel strap around the circumference of the coil and, occasionally, through the "eye" of the coil. After a customer receives the coil, it must remove and dispose of the strap segments before using the coil. One can use a strap-removal robot-sometimes referred to as a "debander"—to cut the strap segments from the coil and to deliver them to a winder. The winder winds the strap segments into coils, which the customer then disposes of or recycles. While the strap coils are more compact and easier to handle, store, and transport than long segments of flexible steel strap, there's a chance they can uncoil during handling, storage, or transport.

SUMMARY

Various embodiments of the present disclosure provide a strap-winding and strap-coil-deforming system configured to wind a strap segment into a coil and then deform the strap coil to render it more compact and to reduce the likelihood that it will uncoil during handling, storage, or transport. The deformed strap coil is introduced into a discharge chute to discharge it away from the strap-winding and strap-coil-deforming system for further handling, storage, or transport.

One embodiment of the strap-winding and strap-coil-deforming system of the present disclosure comprises a containment wall; first, second, and third gates movable between respective open positions and respective closed positions; first and second deformers comprising first and second deforming surfaces, wherein the first and second deformers are movable between respective retracted positions and deforming positions; and a winding assembly comprising a winding-assembly carriage supporting a rotatable winding head comprising multiple winding fingers, wherein the winding-assembly carriage is movable between a collecting position and a winding position, wherein the winding head is movable between a retracted position and a winding position. The containment wall, the first and second gates, and the first deforming surface of the first deformer at least partially define a first deforming chamber. The containment wall, the second and third gates, and the second deforming wall of the second deformer at least partially define a second deforming chamber.

One embodiment of a strap-winding and strap-coil-deforming process of the present disclosure comprises: rotating a winding head to wind a strap segment into a coil; deforming the strap coil in a first deforming chamber; and after the deformed strap coil has moved from the first deforming chamber into a second deforming chamber, further deforming the strap coil in the second deforming chamber.

DETAILED DESCRIPTION

Figure 1:
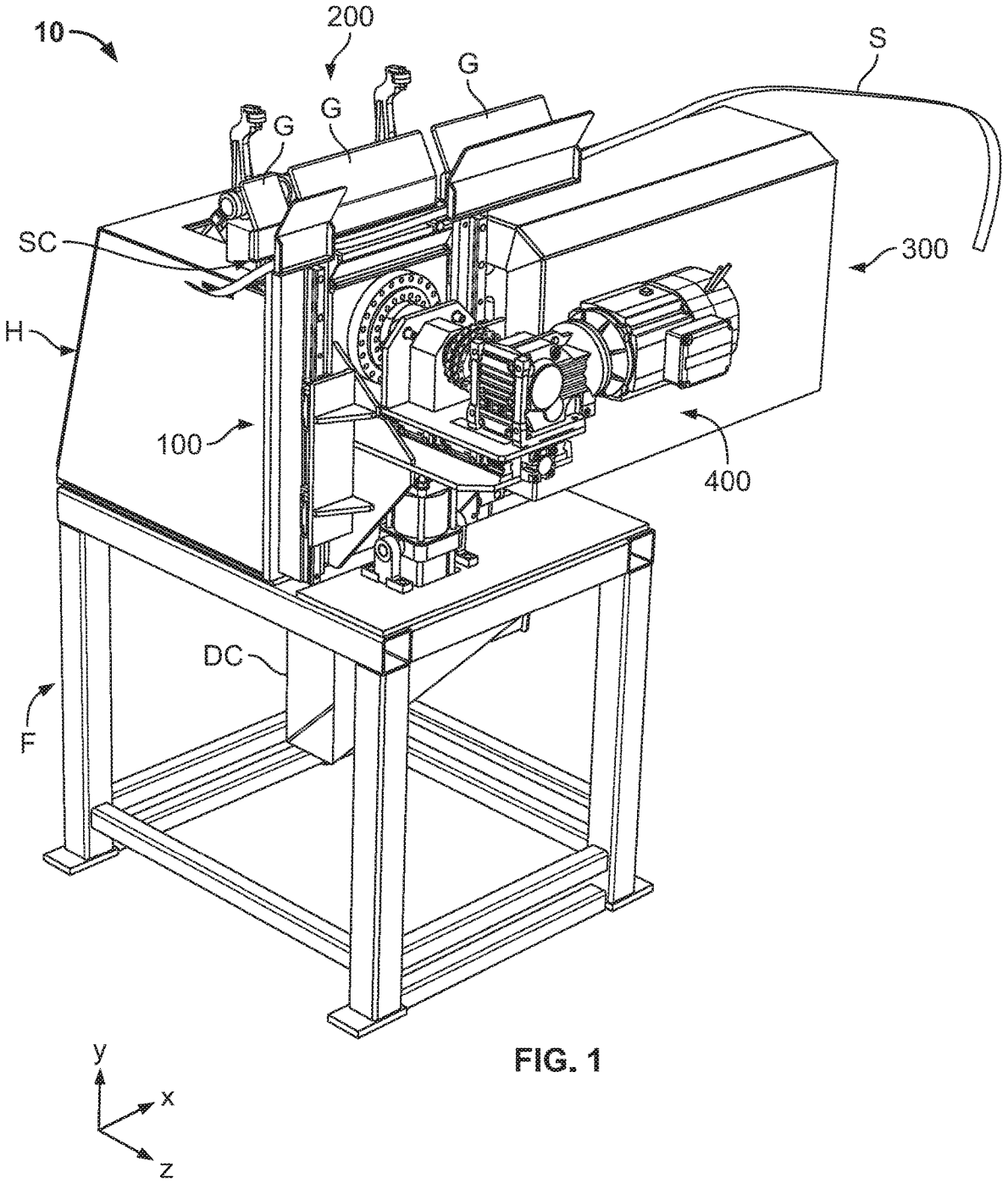
FIG. 1 is a perspective view of one example embodiment of a strap-winding and strap-coil-deforming system of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connection of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, etc., are not intended to be limited to direct mounting methods, but should be interpreted broadly to include indirect and operably coupled, mounted, connected, and like mounting methods. This specification is intended to be taken as a whole and interpreted in accordance with the principles of the present disclosure and as understood by one of ordinary skill in the art.

Various embodiments of the present disclosure provide a strap-winding and strap-coil-deforming system configured to wind a strap segment into a coil and then deform the strap coil to render it more compact and to reduce the likelihood that it will uncoil during handling, storage, or transport. The deformed strap coil is introduced into a discharge chute to discharge it away from the strap-winding and strap-coil-deforming system for further handling, storage, or transport.

Figure 2:
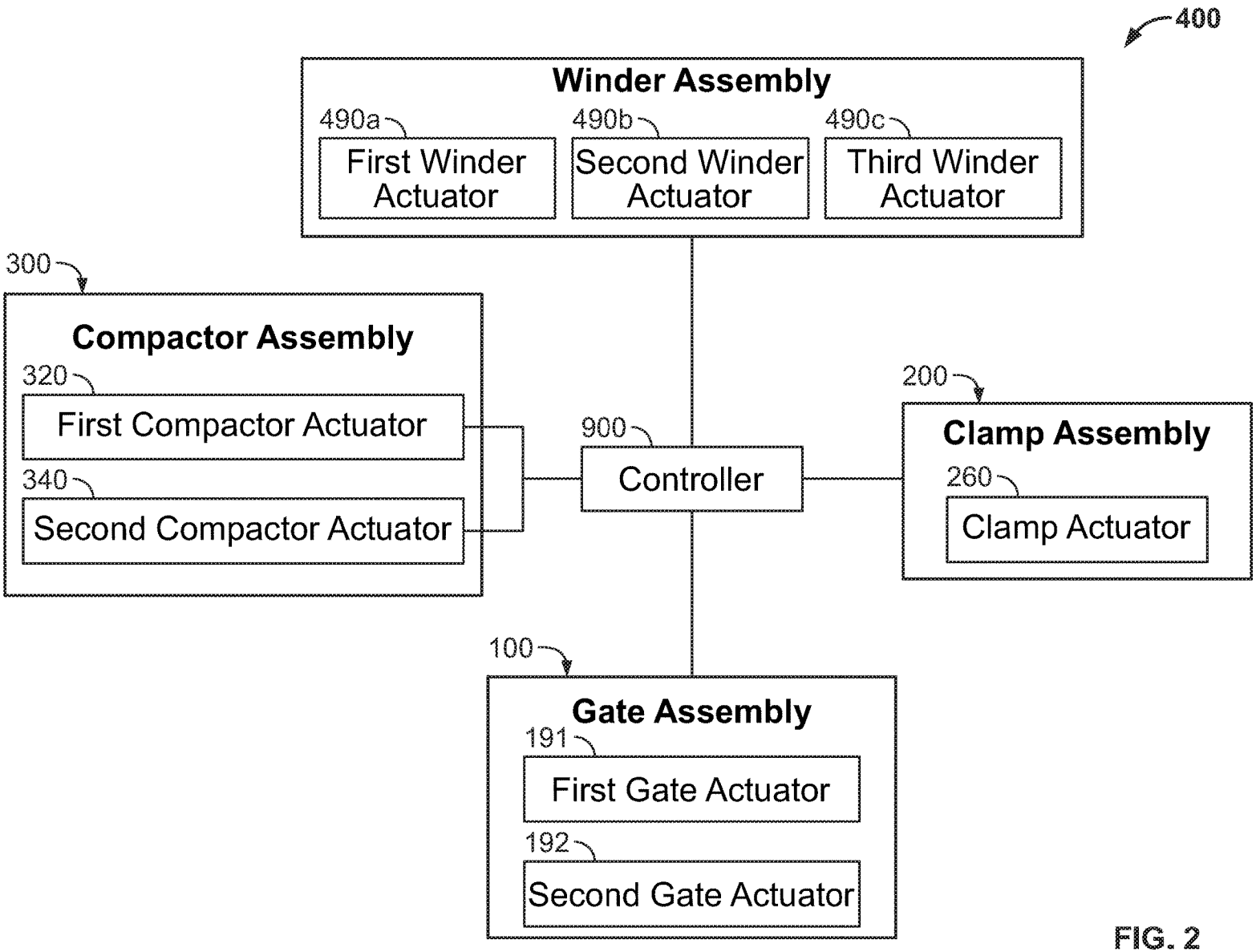
FIG. 2 is a block diagram showing certain components of the strap-winding and strap-coil-deforming system of FIG. 1.
Figure 3A:
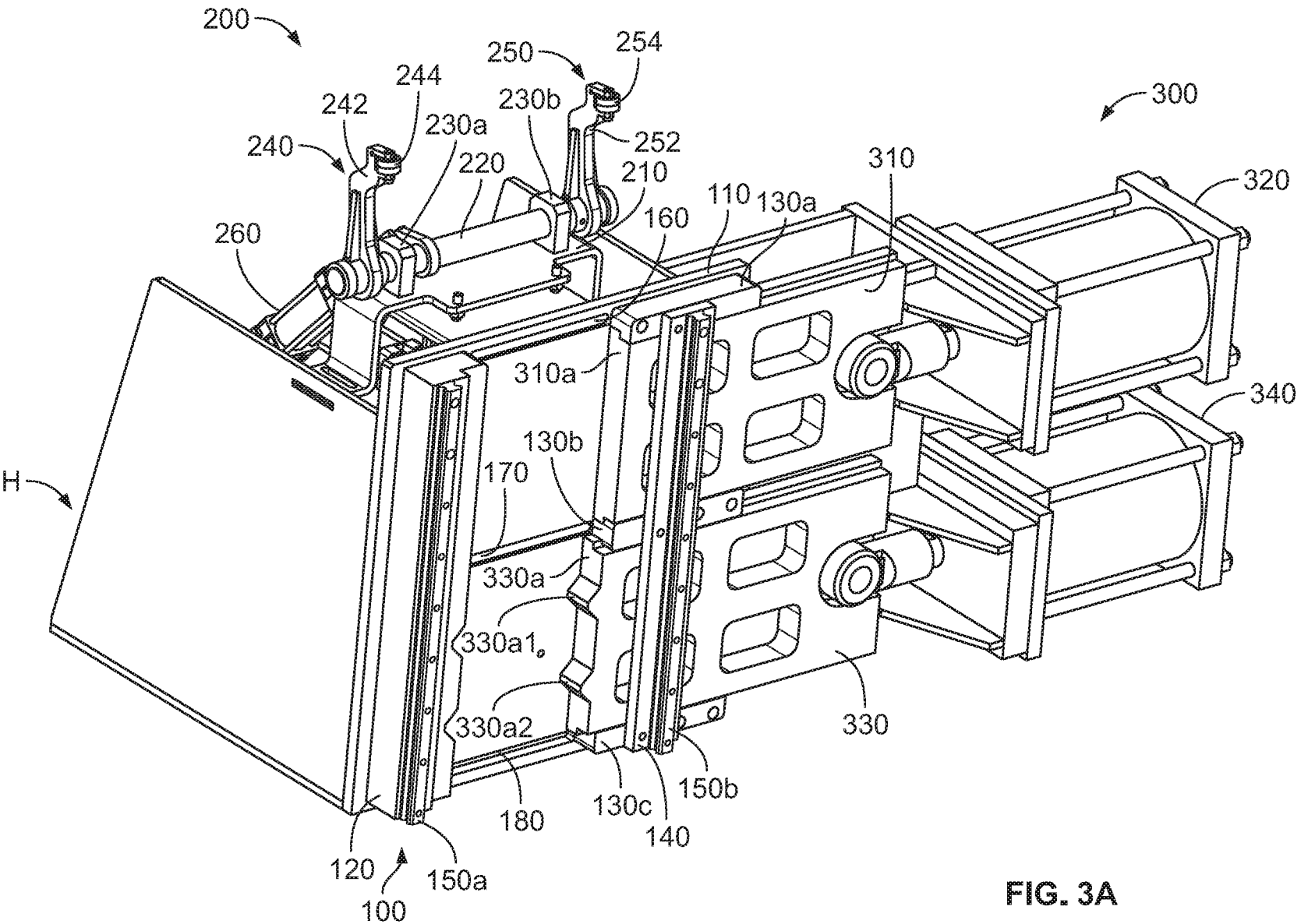
FIGS. 3A and 3B are perspective views of the housing, the gate assembly, the clamping assembly, and the deforming assembly of the strap-winding and strap-coil-deforming system of FIG. 1.
Figure 3B:
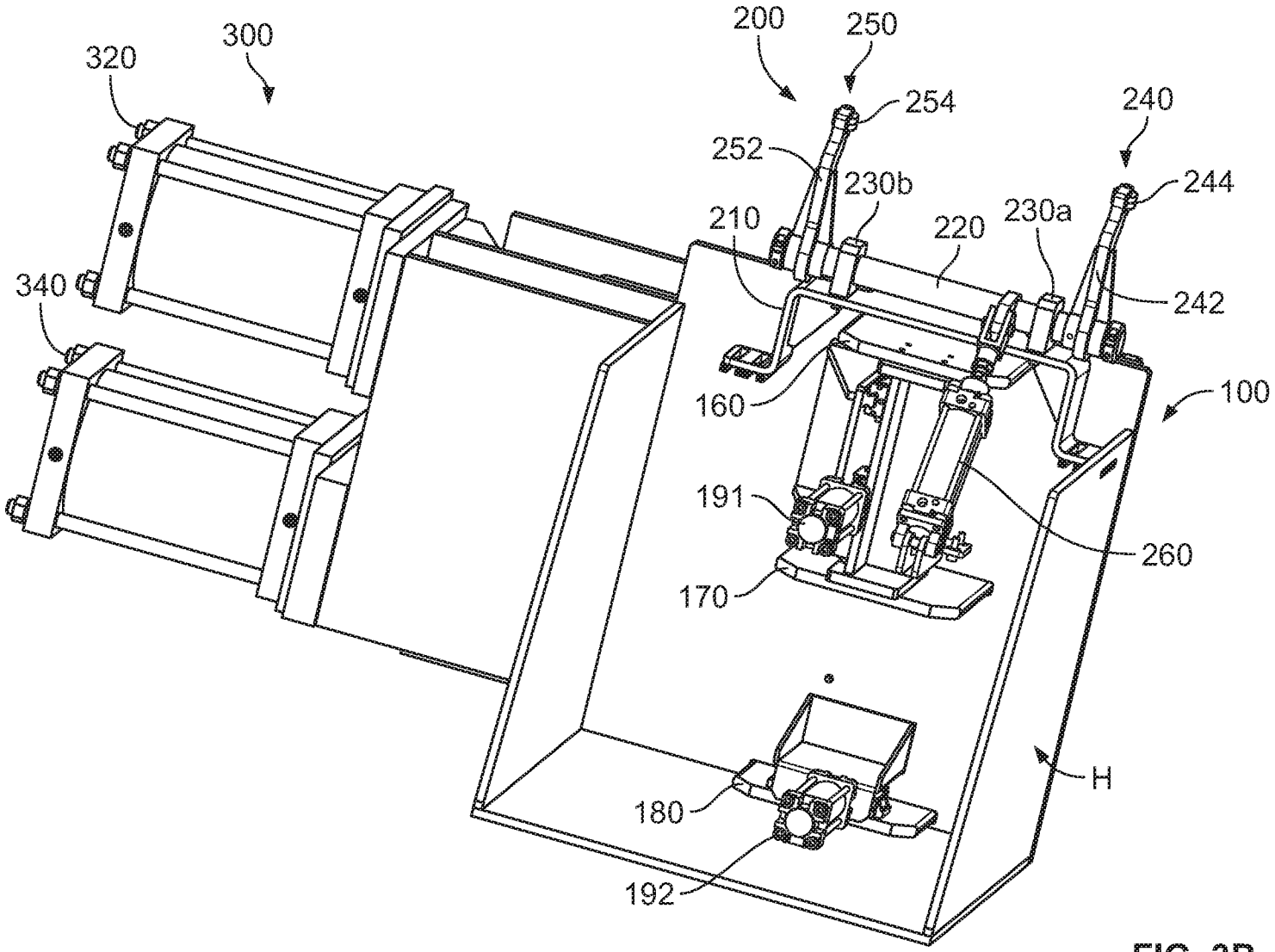

FIGS. 1 and 2 show one example embodiment of a strap-winding and strap-coil-deforming system 10 (sometimes referred to below as the "system 10" for brevity) of the present disclosure and components thereof. The system 10 includes a frame F, a housing H, a discharge chute DC, multiple strap guides G, a gate assembly 100, a clamping assembly 200, a deforming assembly 300, a winding assembly 400, and a controller 900. The coordinate system shown in FIG. 1 is used as a frame of reference for directional movement of various components of the system 10 in the X-, Y-, and Z-directions (which are perpendicular to one another in this example embodiment).

The frame F supports the assemblies and components of the system 10. The frame F is formed from any suitable combination of solid members, tubular members, plates, and/or any other suitable components attached to one another (or from a bent single piece of material). The housing H is shaped to at least partially enclose portions of the gate assembly 100 and the clamping assembly 200. The housing H is supported by the frame F and formed from any suitable combination of solid members, tubular members, plates, and/or any other suitable components fastened together (or from a bent single piece of material). One or more of the strap guides G are connected to the housing H and, in conjunction with certain components of the gate assembly 100 and the winding assembly 400 (described below), form a strap-receiving channel SC sized, shaped, positioned, and otherwise configured to receive the strap segment S. The discharge chute DC is shaped and positioned (relative to the gate assembly 100, as described below) to direct deformed strap coils away from the system 10 for further processing or storage. The discharge chute DC is supported by the frame F and formed from any suitable combination of solid members, tubular members, plates, and/or any other suitable components fastened together (or from a bent single piece of material).

The gate assembly 100, which is best shown in FIGS. 3A-5, partially defines the strap-receiving channel SC, supports the strap segment S when introduced into the strap-receiving channel SC, partially defines the first and second deforming chambers 100*a* and 100*b* (described below) in which the strap segment S is wound into a coil and then deformed, partially controls movement of the strap segment S through the first and second deforming chambers 100*a* and 100*b*, and supports the winding assembly 400. The gate assembly 100 is supported by the housing H and the frame F and includes: a first containment wall 110; a backstop 120; first (upper), second (middle), and third (lower) deformer guides 130*a*, 130*b*, and 130*c*; a mounting-rail support 140; first and second winding-assembly mounting rails 150*a* and 150*b*; first (upper), second (middle), and third (lower) gates 160, 170, and 180; first and second gate actuators 191 and 192; and one or more of the strap guides G.

The first containment wall 110 is connected to the housing H (and in this example embodiment extends in the X-Y plane). The backstop 120 is connected to the first containment wall 110. As best shown in FIG. 4B, the backstop 120 includes first and second deforming surfaces 120*a* and 120*b*. First and second indentations 120*b*1 and 120*b*2 are defined in the second deforming surface 120*b*. The first (upper), second (middle), and third (lower) deformer guides 130*a*, 130*b*, and 130*c* are connected to the first containment wall 110 and are spaced-apart from the backstop 120 in the X-direction and spaced-apart from one another in the Y-direction. The mounting-rail support 140 is connected to the first (upper), second (middle), and third (lower) deformer guides 130*a*, 130*b*, and 130*c*. The first winding-assembly mounting rail 150*a* is connected to the backstop 120, and the second winding-assembly mounting rail 150*b* is connected to the mounting-rail support 140.

Figure 4A:
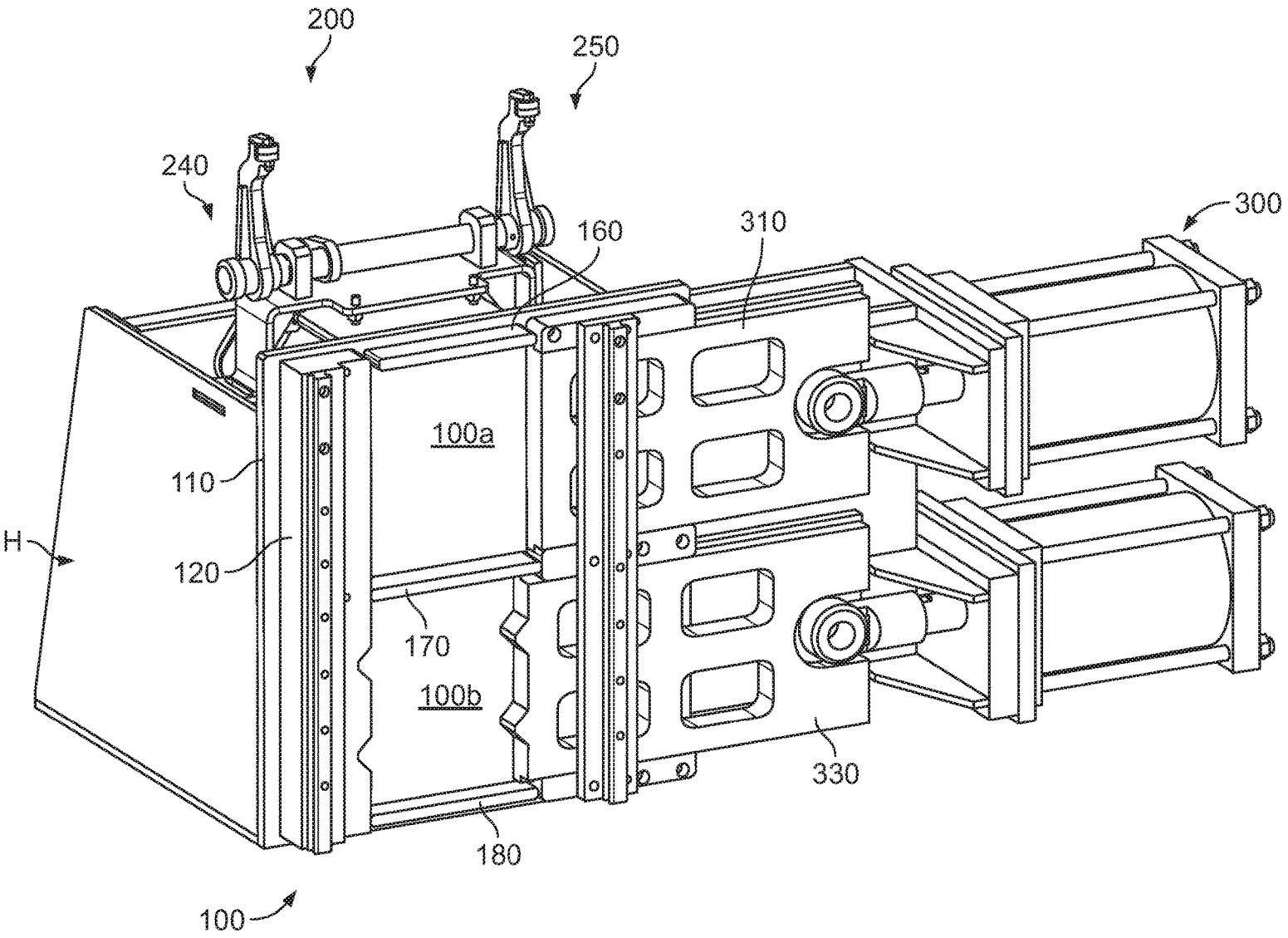
FIGS. 4A and 4B are similar to FIGS. 3A and 3B, but with certain components in different positions than those shown in FIGS. 3A and 3B.
Figure 4B:
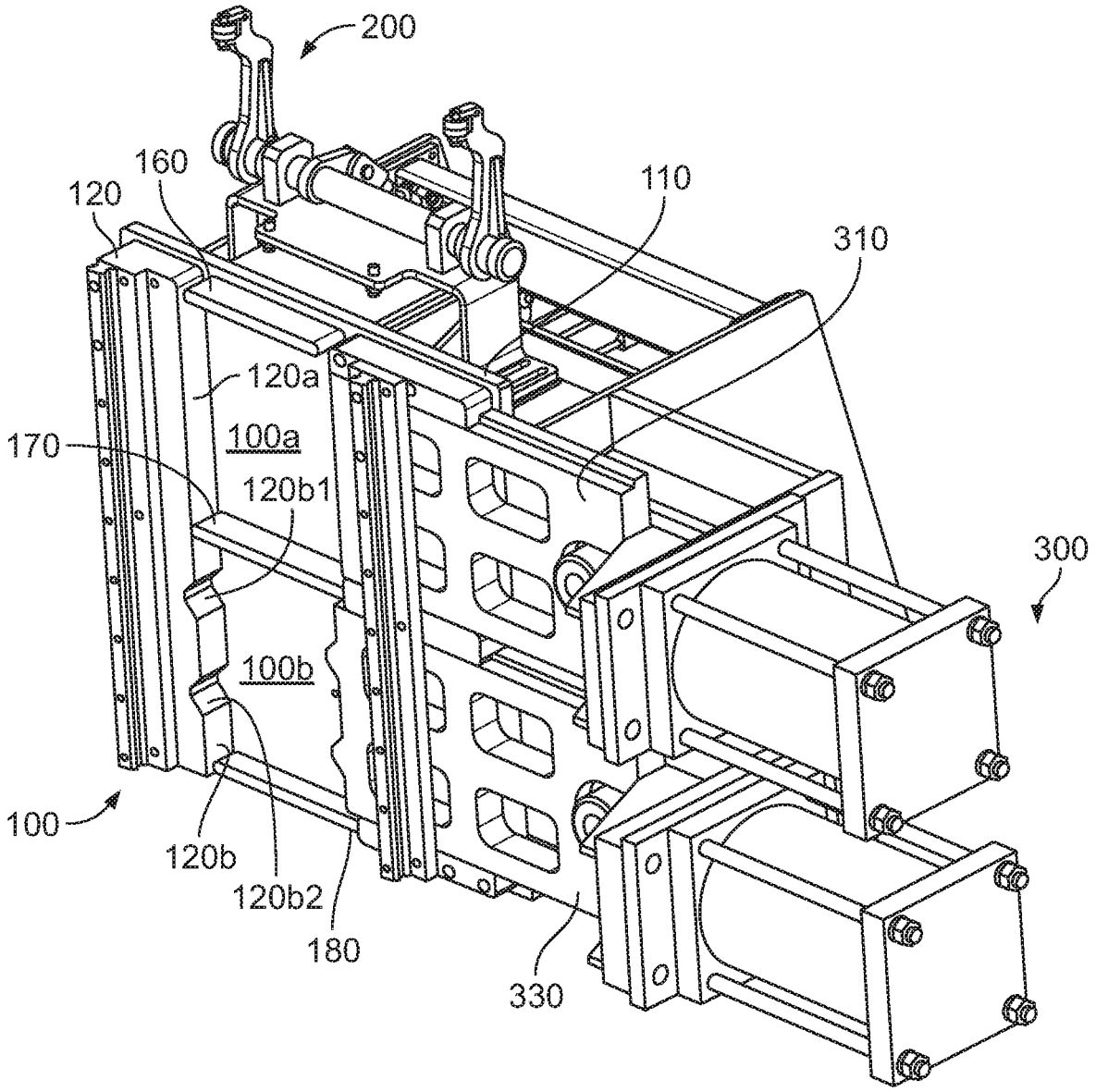
Figure 5:
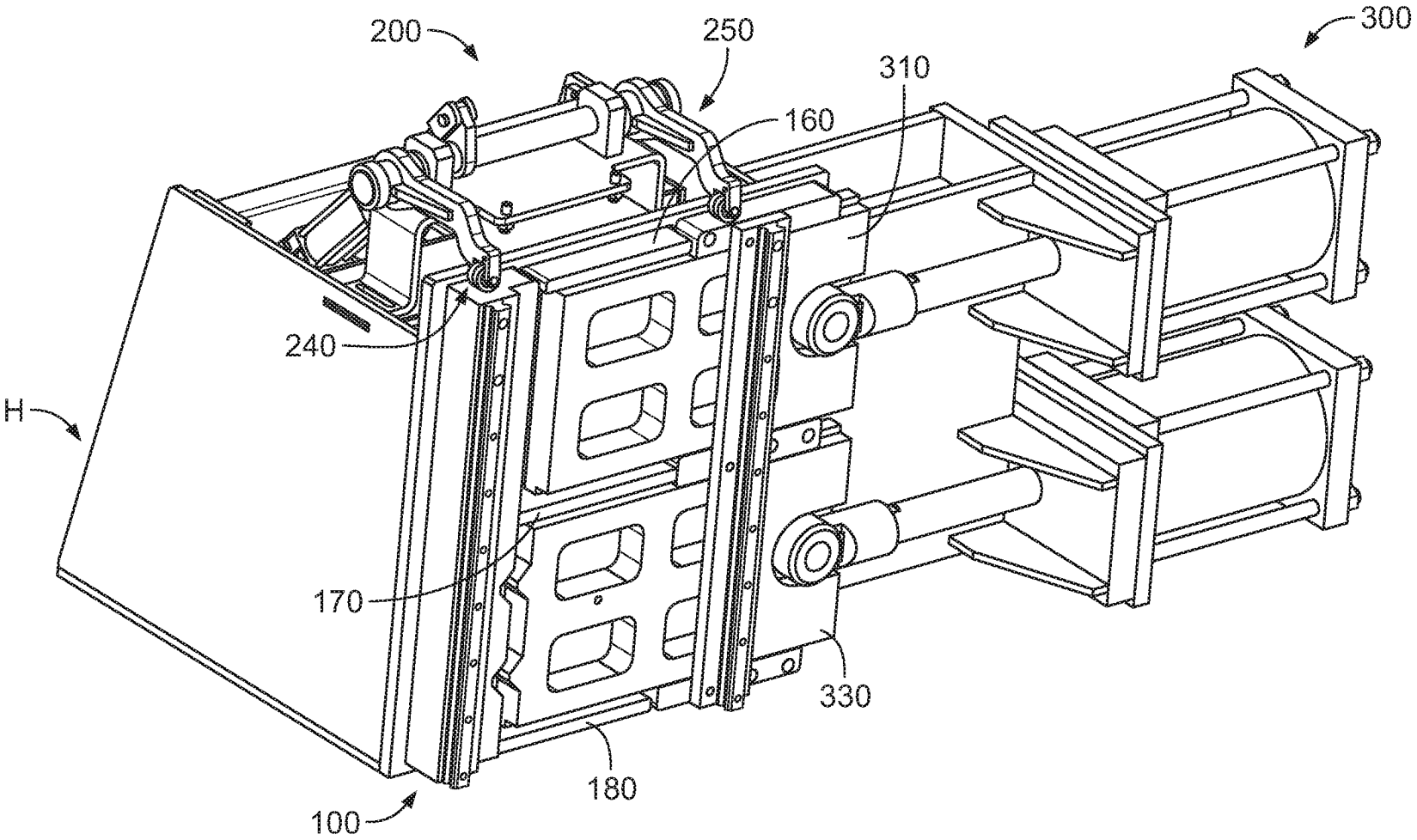
FIG. 5 is similar to FIGS. 3A and 4A, but with certain components in different positions than those shown in FIGS. 3A and 4A.

A first gate 160 is supported by the housing H and movable in the Z-direction through an upper slot (not labeled) defined through the first containment wall 110 between an open (retracted) position (FIG. 3A) and a closed (extended) position (FIGS. 4A-5). A second gate 170 is supported by the housing H and movable in the Z-direction through a middle slot (not labeled) defined through the first containment wall 110 between an open (retracted) position (FIG. 3A) and a closed (extended) position (FIGS. 4A-5). A third gate 180 is supported by the housing H and movable in the Z-direction through a lower slot (not labeled) defined through the first containment wall 110 between an open (retracted) position (FIG. 3A) and a closed (extended) position (FIGS. 4A-5). The first, second, and third gates 160, 170, and 180 are spaced-apart from one another in the Y-direction and are generally aligned with the first (upper), second (middle), and third (lower) deformer guides 130*a*, 130*b*, and 130*c*, respectively.

The first gate actuator 191 is supported by the housing H and is operably connected to the first and second gates 160 and 170 and configured to simultaneously move the first and second gates 160 and 170 between their respective open and closed positions. The second gate actuator 192 is supported by the housing H and is operably connected to the third gate 180 and configured to move the third gate 180 between its respective open and closed positions. That is, in this example embodiment, the first and second gates cannot move independently of one another, but can (together) move independently of the third gate. In this example embodiment, the first and second gate actuators 191 and 192 include pneumatic cylinders, though they may include any other suitable actuators, such as hydraulic cylinders or electric motors, in other embodiments. In other embodiments, a single gate actuator is operably connected to all three gates and configured to simultaneously move all three gates between their respective open and closed positions. That is, in these embodiments, the gates cannot move independently of one another. In further embodiments, three gate actuators are operably connected to the respective gates to move them between their respective open and closed positions. That is, in these embodiments, each gate can move independently of the other gates.

One or more of the strap guides G are connected to the first containment wall 110, the backstop 120, and/or the first (upper) deformer guide 130*a*. These strap guides G, the other strap guides G (described below), the upper surface of the backstop 120, and the upper surface of the deformer guide 130*a* collectively define the strap-receiving channel SC.

The clamping assembly 200, which is best shown in FIGS. 3A-5, clamps the strap segment S against clamping surfaces of certain components of the gate assembly 100 after the strap segment S is introduced into the system 10. The clamping assembly 200 is supported by the housing H and includes: a clamping-assembly support 210, a pivot 220, first and second pivot mounts 230*a* and 230*b*, first and second strap clamps 240 and 250, and a clamp actuator 260.

The clamping-assembly support 210 is connected to the housing H. The first and second pivot mounts 230*a* and 230*b* are connected to the clamping-assembly support 210, and the pivot 220 is received in and rotatable relative to the first and second pivot mounts 230*a* and 230*b*. The first and second strap clamps 240 and 250 are fixedly connected to the pivot 220 to rotate with the pivot 220. More specifically, the first and second strap clamps 240 and 250 include first and second strap clamp arms 242 and 252 fixedly connected to the pivot 220 at one end. Rollers 244 and 254 are mounted to the free ends of the respective first and second strap clamp arms 242 and 252.

The clamp actuator 260 is supported by the housing H and is operably connected to the pivot 220 and configured to rotate the pivot 220 and the first and second strap clamps 240 and 250 connected to the pivot 220 between a strap-insertion position (FIGS. 3A-4B) and a strap-clamp position (FIG. 5). In this example embodiment, the clamp actuator 260 includes a pneumatic cylinder, though it may include any other suitable actuator, such as a hydraulic cylinder or an electric motor, in other embodiments. When in the strap-clamping position, the first and second strap clamps 240 and 250 are positioned to clamp the strap segment onto clamping surfaces (not labeled) of the backstop 120 and the first (upper) deformer guide 130*a*, respectively, to hold the strap segment in place before the winding head engages the strap segment (as described below). When in the strap-insertion position, the first and second strap clamps 240 and 250 are removed from the strap-receiving channel SC so as not to interfere with introduction of the strap-segment S into the strap-receiving channel SC.

The deforming assembly 300, which is best shown in FIGS. 3A-5, partially defines the first and second deforming chambers 100*a* and 100*b* (described below) in which the strap segment S is wound into a coil and then deformed. The deforming assembly 300 is supported by the housing H and the frame F and includes first and second deformers 310 and 330 and first and second deformer actuators 320 and 340.

The first deformer 310 is supported by and slidably received between the first (upper) and second (middle) deformer guides 130*a* and 130*b* and is movable in the X-direction between a retracted position (FIGS. 3A-4B) and a deforming position (FIG. 5). The deformer 310 includes a first deforming surface 310*a* facing the first deforming surface 120*a* of the backstop 120. The second deformer 330 is supported by and slidably received between the second (middle) and third (lower) deformer guides 130*b* and 130*c* and is movable in the X-direction between a retracted position (FIGS. 3A-4B) and a deforming position (FIG. 5). The deformer 330 includes a second deforming surface 330*a* facing the second deforming surface 120*b* of the backstop 120. First and second projections 330*a*1 and 330*a*2 extend from the second deforming surface 330*a* and are sized, shaped, positioned, and otherwise configured to be respectively received in the first and second indentations 120*b*1 and 120*b*2 defined in the second deforming surface 120*b* of the backstop 120.

The first deformer actuator 320 is supported by the housing H and is operably connected to the first deformer 310 and configured to move the first deformer 310 between its retracted and deforming positions. Similarly, the second deformer actuator 340 is supported by the housing H and is operably connected to the second deformer 330 and configured to move the second deformer 330 between its retracted and deforming positions. In this example embodiment, the first and second deformer actuators 320 and 340 include pneumatic cylinders, though they may include any other suitable actuator, such as hydraulic cylinders or electric motors, in other embodiments. In other embodiments, a single deformer actuator is operably connected to both deformers and configured to simultaneously move both deformers between their respective retracted and deforming positions. That is, in these embodiments, the deformers cannot move independently of one another.

The winding assembly 400, which is best shown in FIGS. 6A-8B, partially defines the strap-receiving channel SC, partially defines the first and second deforming chambers 100*a* and 100*b* (described below) in which the strap segment S is wound into a coil and then deformed, moves the strap segment S into the first deforming chamber 100*a*, and winds the strap segment S into a coil. The winding assembly 400 is supported by the frame F and the gate assembly 100 and includes: a winding-assembly carriage 410; first, second, third, and fourth rail connectors 420*a*, 420*b*, 420*c*, and 420*d*; a guide plate 424; a guide-plate mount 425; first and second winding-head mounting rails 430*a* and 430*b*; a winding-head carriage 440; fifth, sixth, seventh, and eighth rail connectors 440*a*, 440*b*, 440*c*, and 440*d*; a winding-head drive train 450; a winding head 460; first, second, and third winding-head stabilizers 470*a*, 470*b*, and 470*c*; and first, second, and third winder actuators 490*a*, 490*b*, and 490*c*.

Figure 6A:
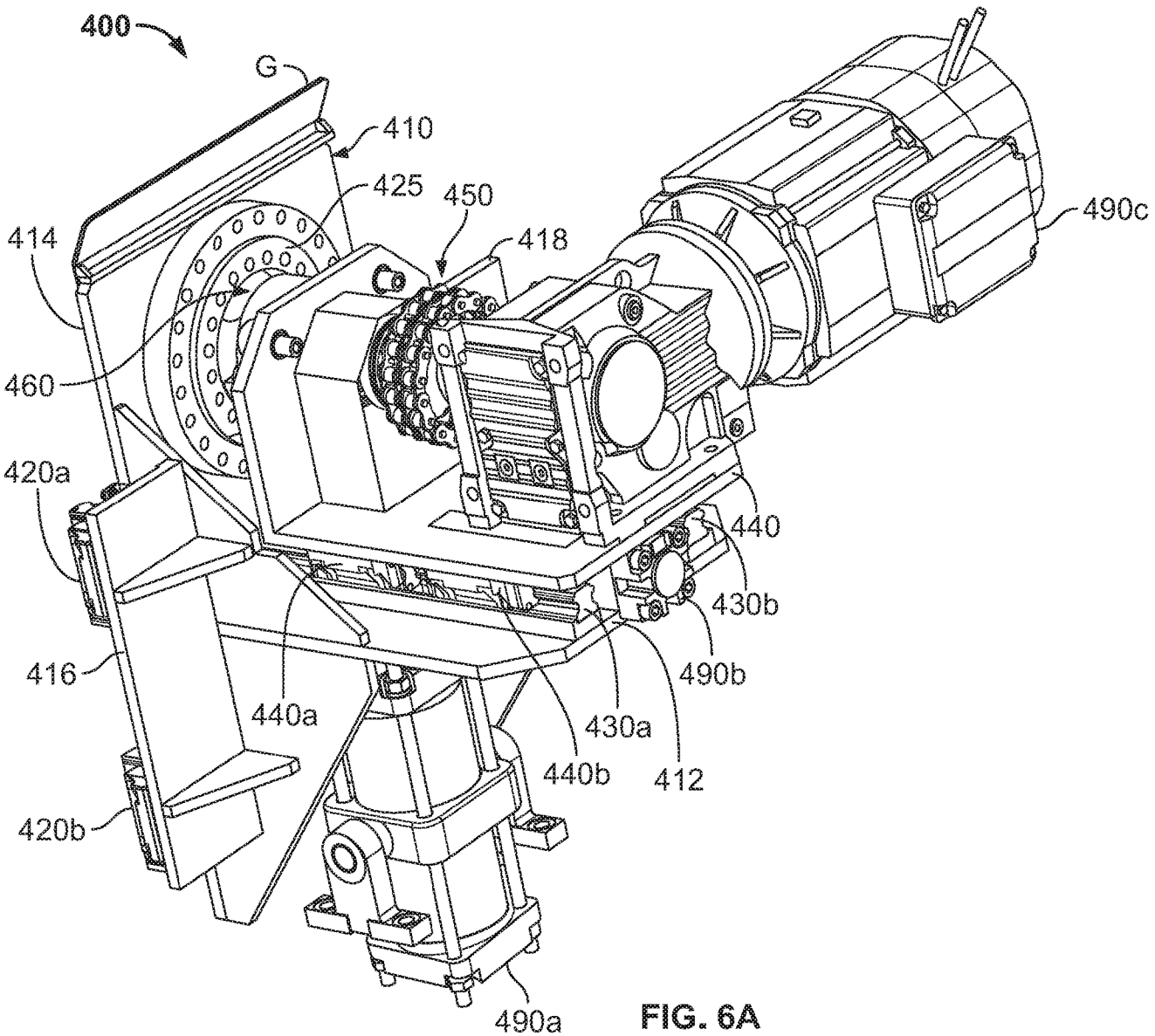
FIGS. 6A and 6B are perspective views of the winding assembly of the strap-winding and strap-coil-deforming system of FIG. 1.
Figure 6B:
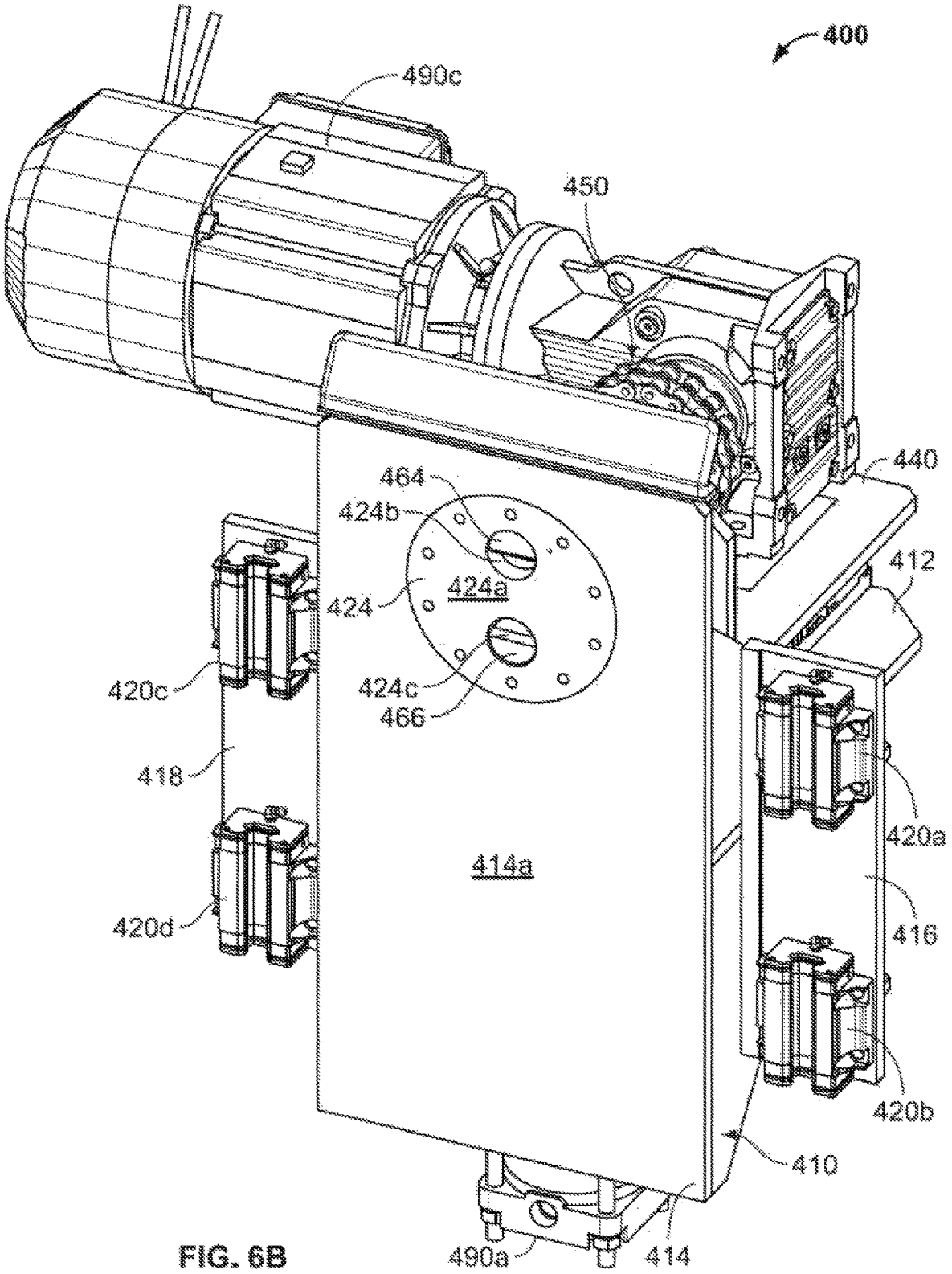
Figure 6C:
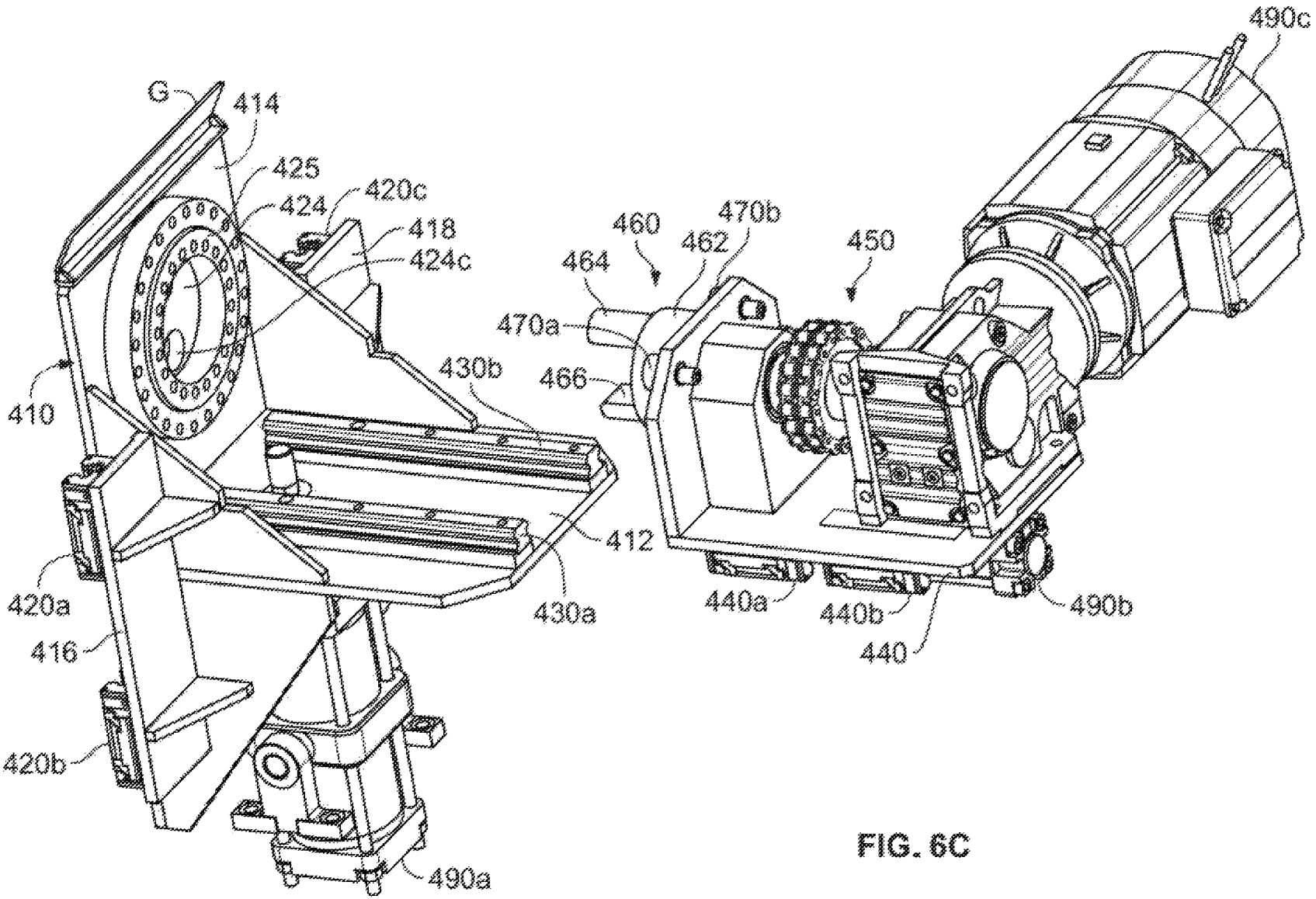
FIG. 6C is a partially exploded perspective view of the winding assembly of FIGS. 6A and 6B.
Figure 8A:
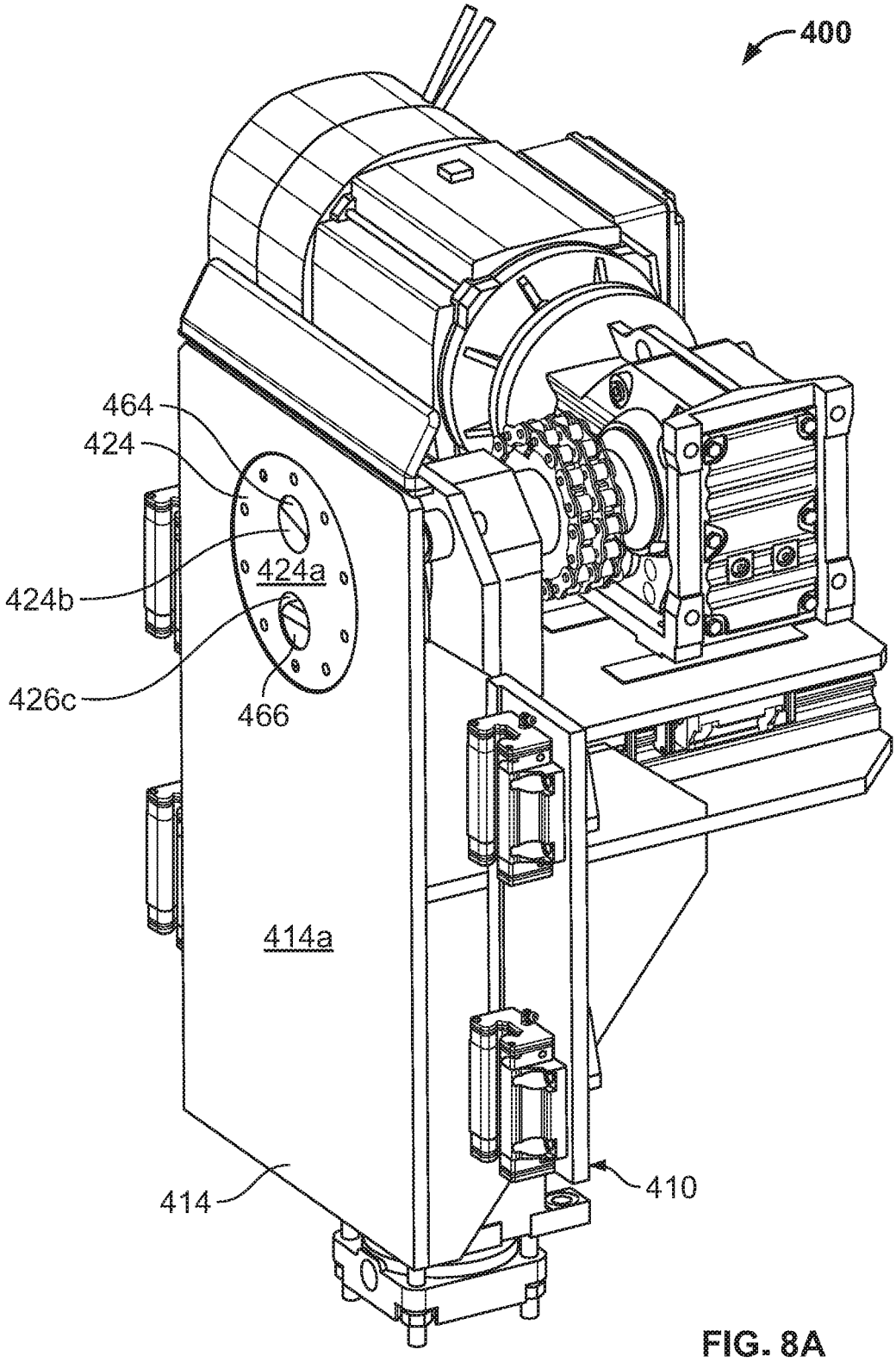
FIGS. 8A and 8B are perspective views of the winding assembly of FIGS. 6A-6C and show the winding head in its retracted and winding positions, respectively.
Figure 8B:
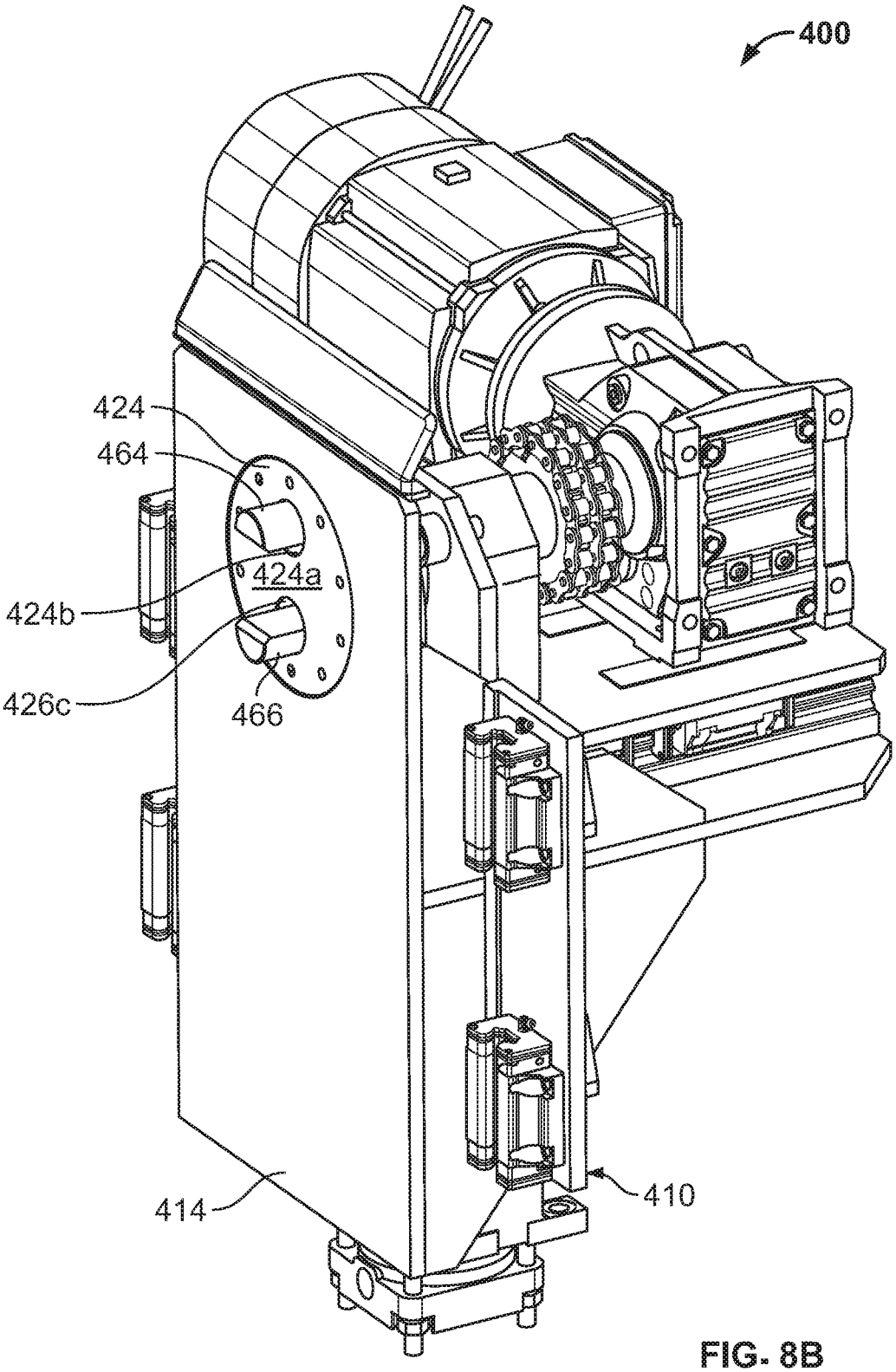

The winding-assembly carriage 410 includes: a winding head support 412, a second containment wall 414 connected to and oriented transversely to the winding head support 412, first and second mounting ears 416 and 418 extending from opposite sides of the second containment wall 414, and one of the strap guides G connected to the second containment wall 414. This strap guide G, the other strap guides G described above, the clamping surface of the backstop 120, and the clamping surface of the deformer guide 130*a* collectively define the strap-receiving channel SC. The first and second rail connectors 420*a* and 420*b* are connected to the first mounting ear 416, and the third and fourth rail connectors 420*c* and 420*d* are connected to the second mounting ear 418. The first and second winding-head mounting rails 430*a* and 430*b* are connected to the winding head support 412. The guide plate 424 is connected to the guide-plate mount 425, which in turn is connected to the second containment wall 414 such that the guide plate 424 is rotatable relative to the second containment wall 414. An exterior face 424*a* of the guide plate 424 is flush with a containment surface 414*a* of the second containment wall 414 (though the surfaces may not be flush in other embodiments). As best shown in FIGS. 6B, 8A, and 8B, first and second finger receiving openings 424*b* and 424*c* are defined through the guide plate 424. These openings are sized and shaped to receive the first and second winding fingers of the winding head 460, as described below.

Figure 7:
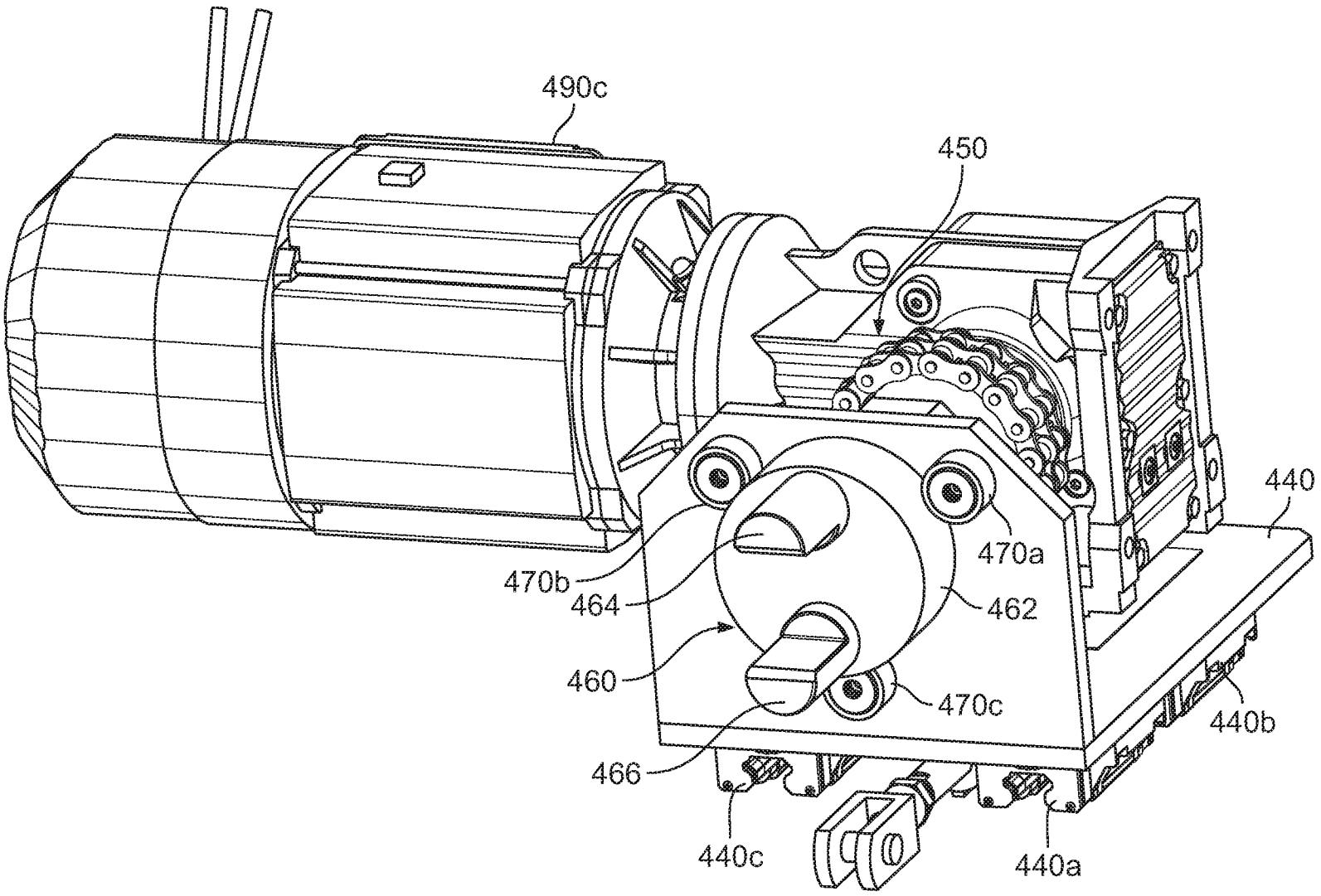
FIG. 7 is a perspective view of part of the winding assembly of FIGS. 6A-6C.

The fifth, sixth, seventh, and eighth rail connectors 440*a*, 440*b*, 440*c*, and 440*d* are connected to the underside of the winding-head carriage 440. The third winder actuator 490*c* is connected to the winding-head carriage 440. The third winder actuator 490*c* is operably connected to the winding head 460 via the winding-head drive train 450 and configured to rotate the winding head 460 around its longitudinal axis (which extends in the Z-direction in this example embodiment). The winding-head drive train 450 may include any suitable component(s), such as shafts and/or gearing. As best shown in FIG. 7, the winding head 460 includes a cylindrical base 462 and opposing, radially spaced first and second winding fingers 464 and 466 extending from the base 462 in the Z-direction. The winding head 460 has a home (rotational) position in which the first and second winding fingers 464 and 466 are oriented such that they are aligned one atop the other in the Y-direction as shown in FIGS. 8A and 8B. As described below, this orientation of the winding fingers enables the winding head 460 to engage and pull the strap into the first deforming chamber 100*a* in preparation for winding. As best shown in FIG. 7, the first, second, and third winding-head stabilizers 470*a*, 470*b*, and 470*c* include rollers that are circumferentially spaced around and contact the base 462 (or are slightly radially spaced from the base in other embodiments). The winding-head stabilizers 470 contact the base 462 to prevent the winding head from wobbling in the X- and Y-directions as the winding head 460 rotates.

The winding-head carriage 440 is movably mounted to the winding-assembly carriage 410 and configured to move relative to the winding-assembly carriage 410 in the Z-direction between a retracted position (FIG. 8A) and a winding position (FIG. 8B). Most specifically, the winding-head carriage 440 is slidably mounted to the winding-assembly carriage 410 via receipt of the first winding-head mounting rail 430*a* in the fifth and sixth rail connectors 440*a* and 440*b* and receipt of the second winding-head mounting rail 430*b* in the seventh and eighth rail connectors 440*c* and 440*d*. When the winding-head carriage 440 is in its retracted position, the first and second winding fingers 464 and 466 are received in the first and second finger receiving openings 424*b* and 424*c* defined through the guide plate 424, and the free ends of the winding fingers are flush with or slightly recessed from the exterior face 424*a* of the guide plate 424. When the winding-head carriage 440 is in its winding position, the first and second winding fingers 464 and 466 extend from the first and second finger receiving openings 424*b* and 424*c* defined through the guide plate 424. The second winder actuator 490*b* is operably connected to the winding-head carriage 440 and configured to move the winding-head carriage 440 between its retracted and winding positions. In this example embodiment, the second winder actuator 490*b* includes a pneumatic cylinder, though it may include any other suitable actuator, such as a hydraulic cylinder or an electric motor, in other embodiments.

Figure 10A:
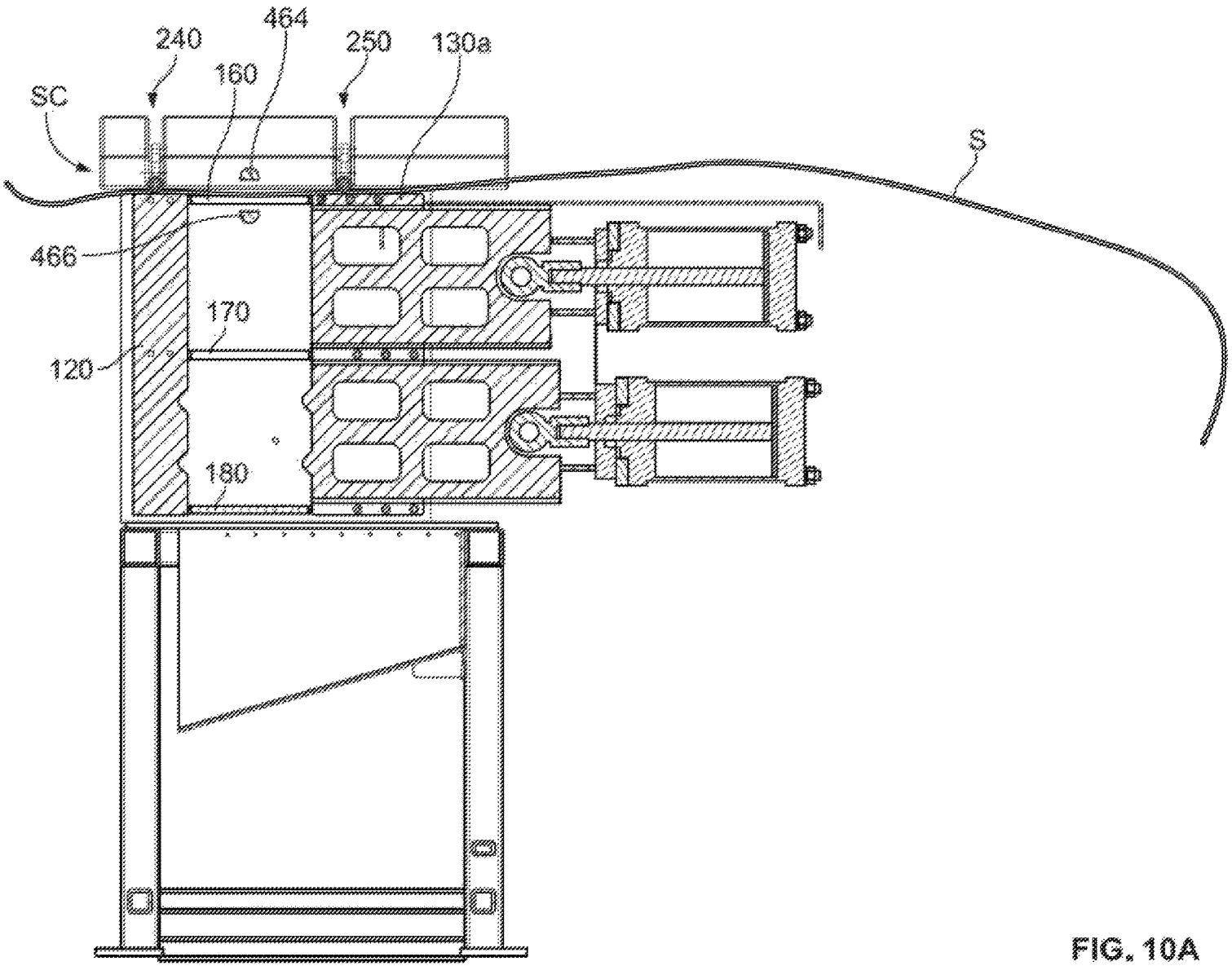
FIGS. 10A-10H are cross-sectional front elevational views of the strap-winding and strap-coil-deforming system of FIG. 1 during certain steps of the strap-winding and strap-coil-deforming process of FIG. 9.
Figure 10B:
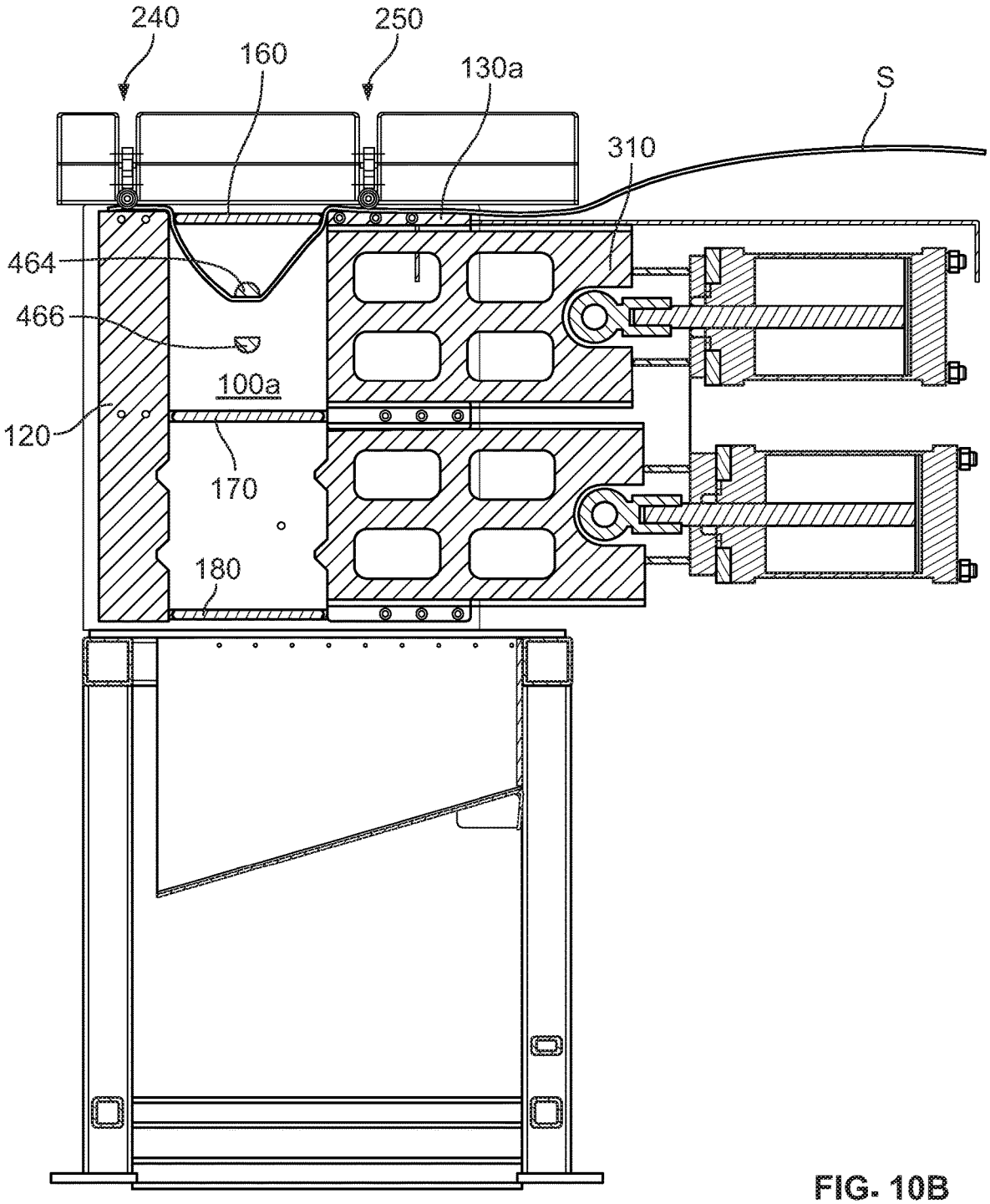
Figure 10C:
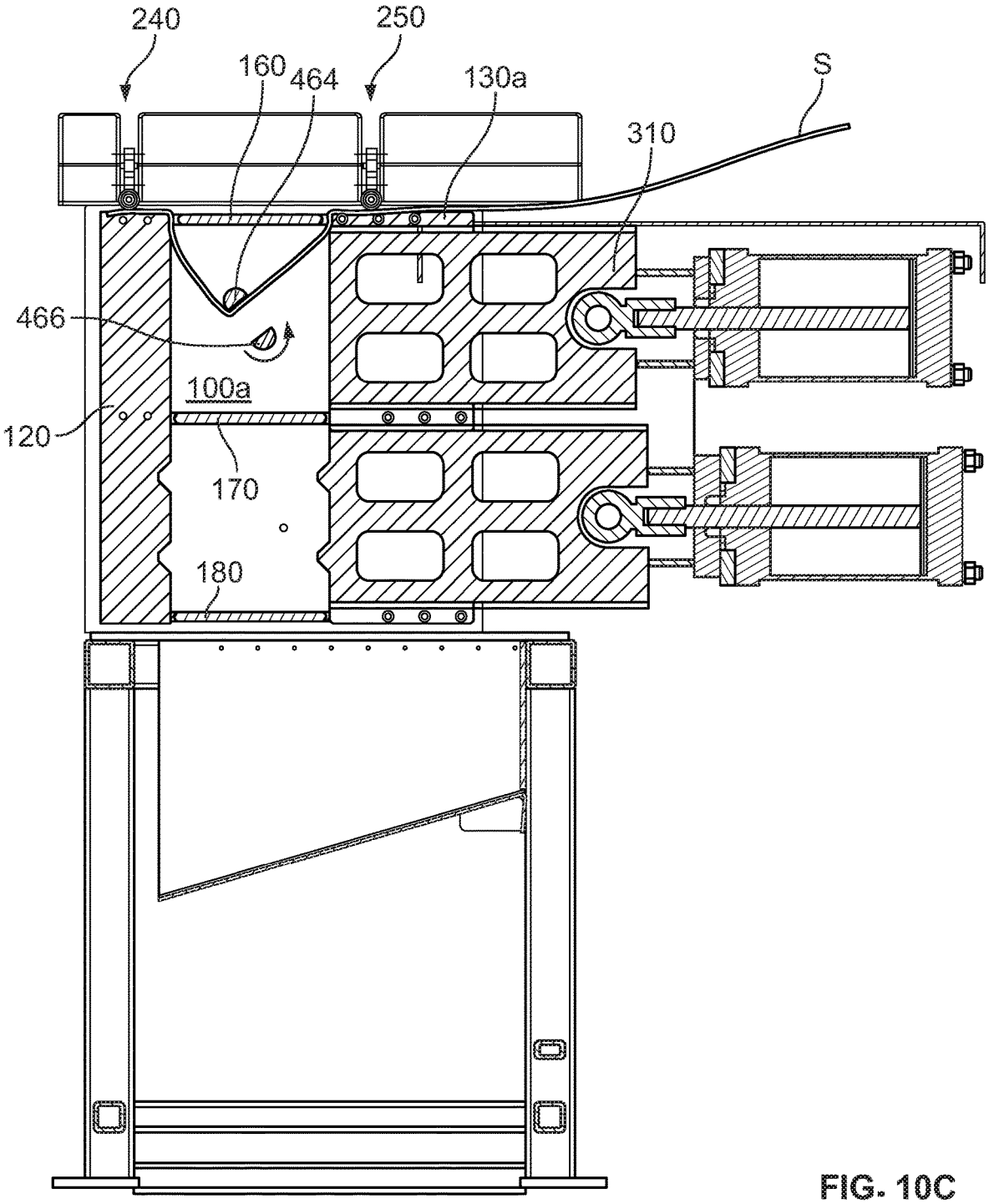

The winding-assembly carriage 410 is movably mounted to the gate assembly 100 and configured to move relative to the gate assembly 100 in the Y-direction between a collecting position (FIG. 10A) and a winding position (FIGS. 1, 10B, and 10C). More specifically, the winding-assembly carriage 410 is slidably mounted to the gate assembly 100 via receipt of the first winding-assembly mounting rail 150*a* in the first and second rail connectors 420*a* and 420*b* and receipt of the second winding-assembly mounting rail 150*b* in the third and fourth rail connectors 420*c* and 420*d*. The first winder actuator 490*a* is operably connected to the winding-assembly carriage 410 and configured to move the winding-assembly carriage 410 between its collecting and winding positions. In this example embodiment, the first winder actuator 490*a* includes a pneumatic cylinder, though it may include any other suitable actuator, such as a hydraulic cylinder or an electric motor, in other embodiments.

Components of the gate assembly 100, the deforming assembly 300, and the winding assembly 400 define the first and second deforming chambers 100*a* and 100*b*, which are best shown in FIGS. 4A and 4B. The first and second deforming chambers 100*a* and 100*b* are spaced-apart in the Y-direction. The first deforming chamber 100*a* contains the strap segment S as the winding assembly 400 winds the strap segment S into a coil and as the first deformer 310 deforms the coiled strap segment S. The second deforming chamber 100*b* contains the deformed strap coil as the second deformer 330 deforms the deformed strap coil. The first deforming chamber 100*a* is bound by the first deforming surface 120*a* of the backstop 120 and the first deforming surface 310*a* of the first deformer 310 in the X-direction, by the (closed) first (upper) gate 160 and the (closed) second (middle) gate 170 in the Y'-direction, and by the first containment wall 110 of the gate assembly 100 and the second containment wall 414 of the winding-assembly carriage 410 of the winding assembly 400 in the Z-direction. The second deforming chamber 100*b* is the volume bound by the second deforming surface 120*b* of the backstop 120 and the second deforming surface 330*a* of the second deformer 330 in the X-direction, by the (closed) second (middle) gate 170 and the (closed) third (lower) gate 180 in the Y-direction, and by the first containment wall 110 of the gate assembly 100 and the second containment wall 414 of the winding-assembly carriage 410 of the winding assembly 400 in the Z-direction.

Figure 9:
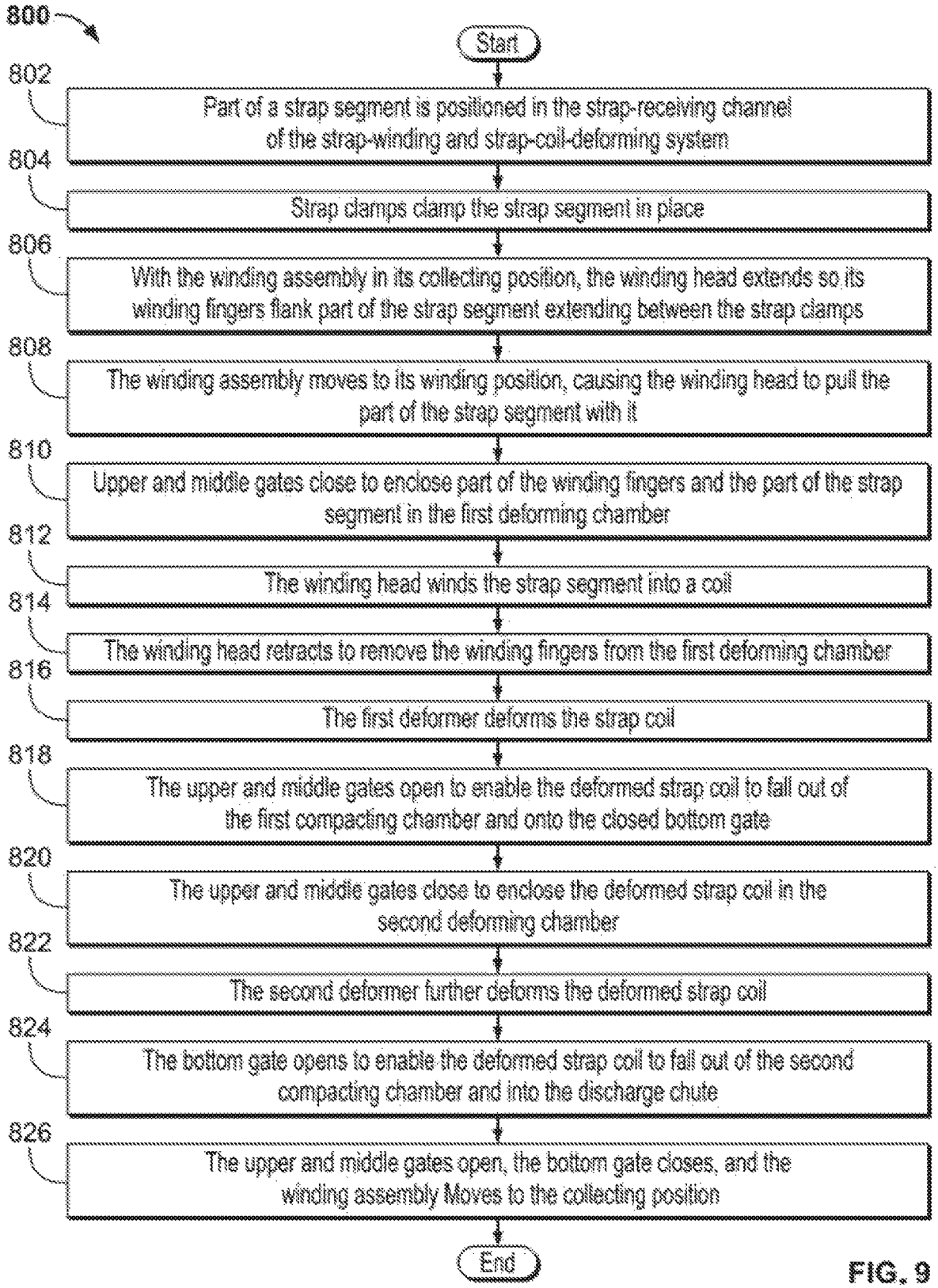
FIG. 9 is a flowchart showing one example of a strap-winding and strap-coil-deforming process of the present disclosure.

The controller 900 includes a processing device (or devices) communicatively connected to a memory device (or devices). For instance, the controller may include a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the system 10 (such as to carry out the strap-winding and strap-coil-deforming process 800 described below with respect to FIG. 9).

As shown in FIG. 2, the controller 900 is communicatively and operably connected to the first and second gate actuators 191 and 192; the clamp actuator 260; the first and second deformer actuators 320 and 340; and the first, second and third winder actuators 490*a*, 490*b*, and 490*c* and configured to receive signals from and to control those components.

Operation of the system 10 to carry out a strap-winding and strap-coil-deforming process 800 for a strap segment S is now described in conjunction with FIGS. 9 and 10A-10H. Initially: the first (upper) gate 160 and the second (middle) gate 170 of the gate assembly 100 are in their respective open positions, the third (lower) gate 180 of the gate assembly 100 is in its closed position, the first and second strap clamps 240 and 250 of the clamping assembly 200 are in their respective strap-insertion positions, the first and second deformers 310 and 330 of the deforming assembly 300 are in their respective retracted positions, the winding-assembly carriage 410 is in its collecting position, the winding-head carriage 440 is in its retracted position, and the winding head 460 is in its home (rotational) position.

After part of a strap segment is positioned in the strap-receiving channel of the strap-winding and strap-coil-deforming system, as block 802 indicates, the strap clamps clamp the strap segment in place, as block 804 indicates. For instance, referring to the example embodiment described above and shown in the Figures, the controller 900 controls the clamp actuator 260 to move the first and second strap clamps 240 and 250 from their respective strap-insertion positions to their respective strap-clamp positions. As the first and second strap clamps 240 and 250 reach their respective strap-clamp positions, the roller 244 of the first strap clamp 240 forces part of the strap segment S onto the clamping surface of the backstop 120, and the roller 254 of the second strap clamp 250 forces another part of the strap segment S onto the clamping surface of the first (upper) deformer guide 130*a* to hold the strap segment S in place.

With the winding assembly in its collecting position, the winding head extends so its winding fingers flank part of the strap segment extending between the strap clamps, as block 806 indicates. Continuing with the above example, the controller 900 controls the second winder actuator 490*b* to move the winding-head carriage 440 from its retracted position to its winding position such that, as shown in FIG. 10A, the first and second winding fingers 464 and 466 of the winding head 460 flank part of the strap segment S that extends between the first and second strap clamps 240 and 250.

The winding assembly moves to its winding position, causing the winding head to pull the part of the strap segment with it, as block 808 indicates, and the upper and middle gates close to enclose part of the winding fingers and the part of the strap segment pulled with the winding fingers in the first deforming chamber, as block 810 indicates. Continuing with the above example, the controller 900 controls the first winder actuator 490*a* to move the winding-assembly carriage 410 from its collecting position to its winding position. As this occurs, the underside of the first winding finger 464 contacts the strap segment S and pulls the strap segment S downward with the winding head 460. The rollers 244 and 254 of the first and second strap clamps 240 and 250 enable the winding head 460 to pull the strap segment S with it while the strap clamps maintain clamping pressure on the strap segment S. The controller 900 controls the first gate actuator 191 to move the first (upper) and second (middle) gates 160 and 170 from their respective open positions to their respective closed positions. As shown in FIG. 10B, this encloses the portions of the first and second winding fingers 464 and 466 projecting from the winding-assembly carriage 410 and part of the strap segment S in the first deforming chamber 100*a*.

Figure 10D:
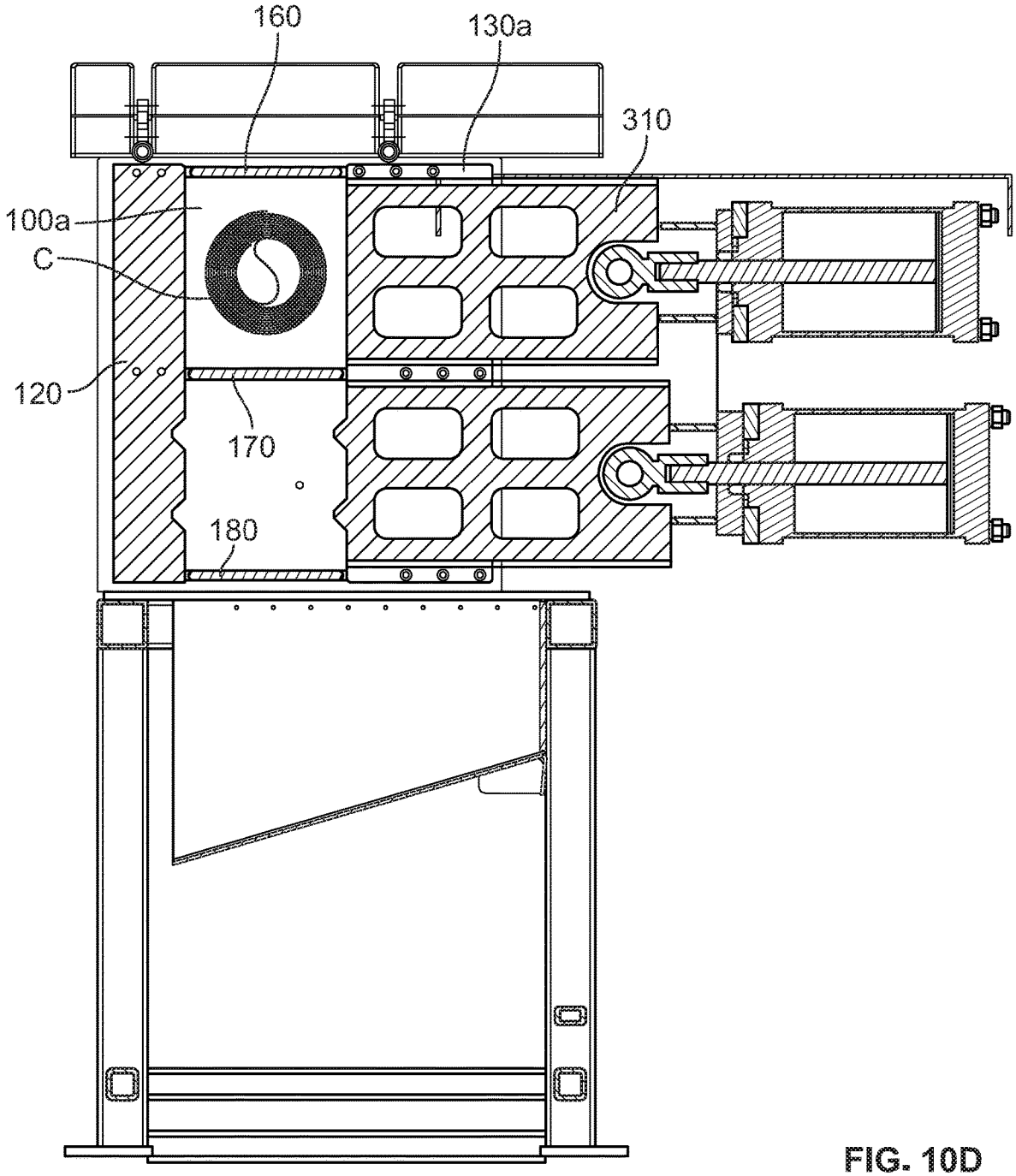

The winding head winds the strap segment into a coil, as block 812 indicates, and then retracts to remove the winding fingers from the first deforming chamber, as block 814 indicates. Continuing with the above example, the controller 900 controls the third winder actuator 490*c* to rotate the winding head 460, as shown in FIG. 10C. As this occurs, the remainder of the strap segment S is pulled into the first deforming chamber 100*a* and wound into a strap coil C. The controller 900 controls the second winder actuator 490*b* to move the winding-head carriage 440 from its winding position to its retracted position such that the first and second winding fingers 464 and 466 are removed from the first deforming chamber 100*a* (and no longer contact the strap coil C), as shown in FIG. 10D.

Figure 10E:
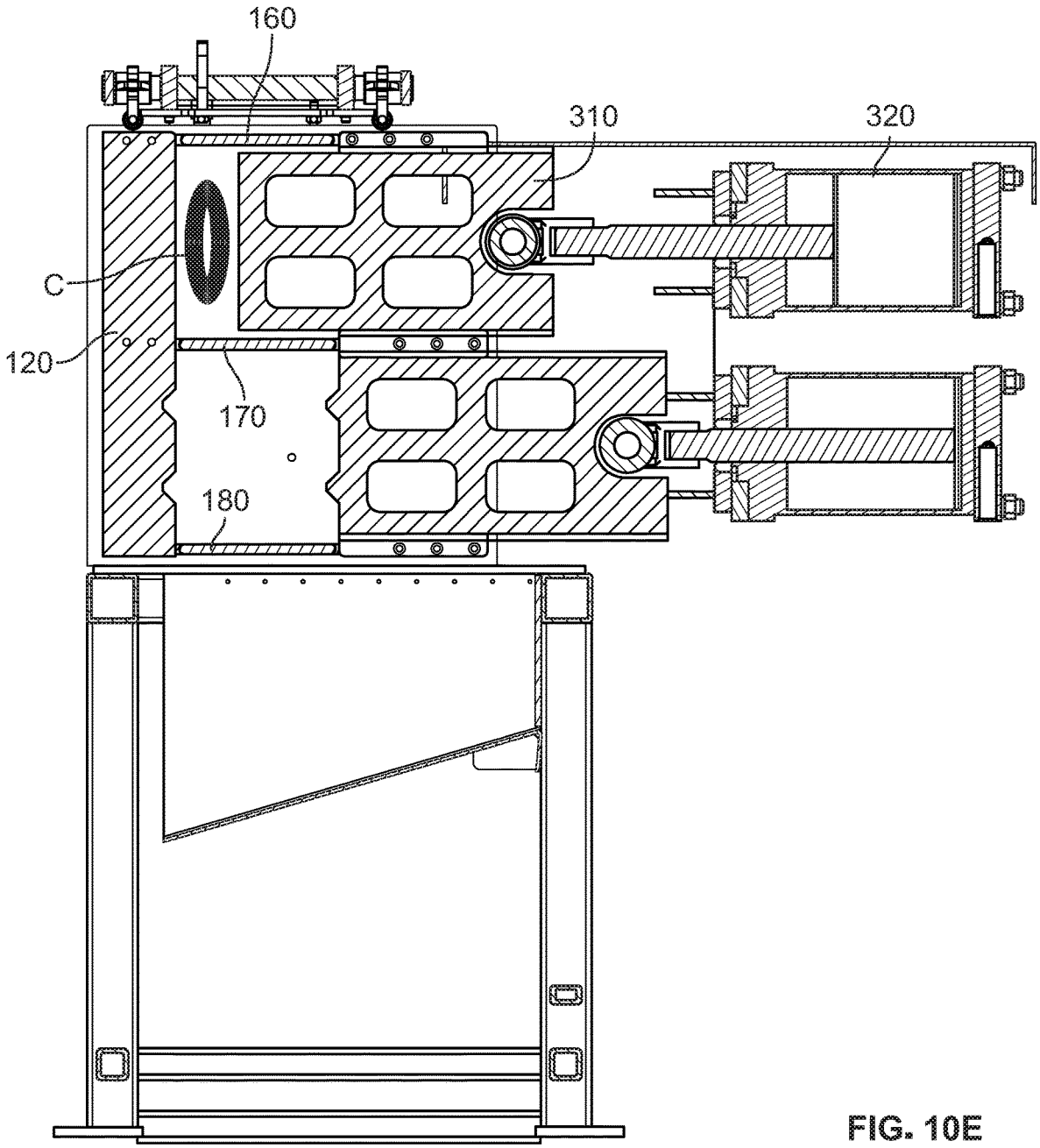

The first deformer deforms the strap coil, as block 816 indicates. Continuing with the above example, the controller 900 controls the first deformer actuator 320 to move the first deformer 310 from its retracted position to its deforming position. As the first deformer 310 moves, its first deforming surface 310*a* contacts the strap coil C and forces the strap coil C against the first deforming surface 120*a* of the backstop 120. Continued movement of the first deformer 310 causes the first deformer 310 to deform the strap coil C into an oblong shape, as shown in FIG. 10E.

Figure 10F:
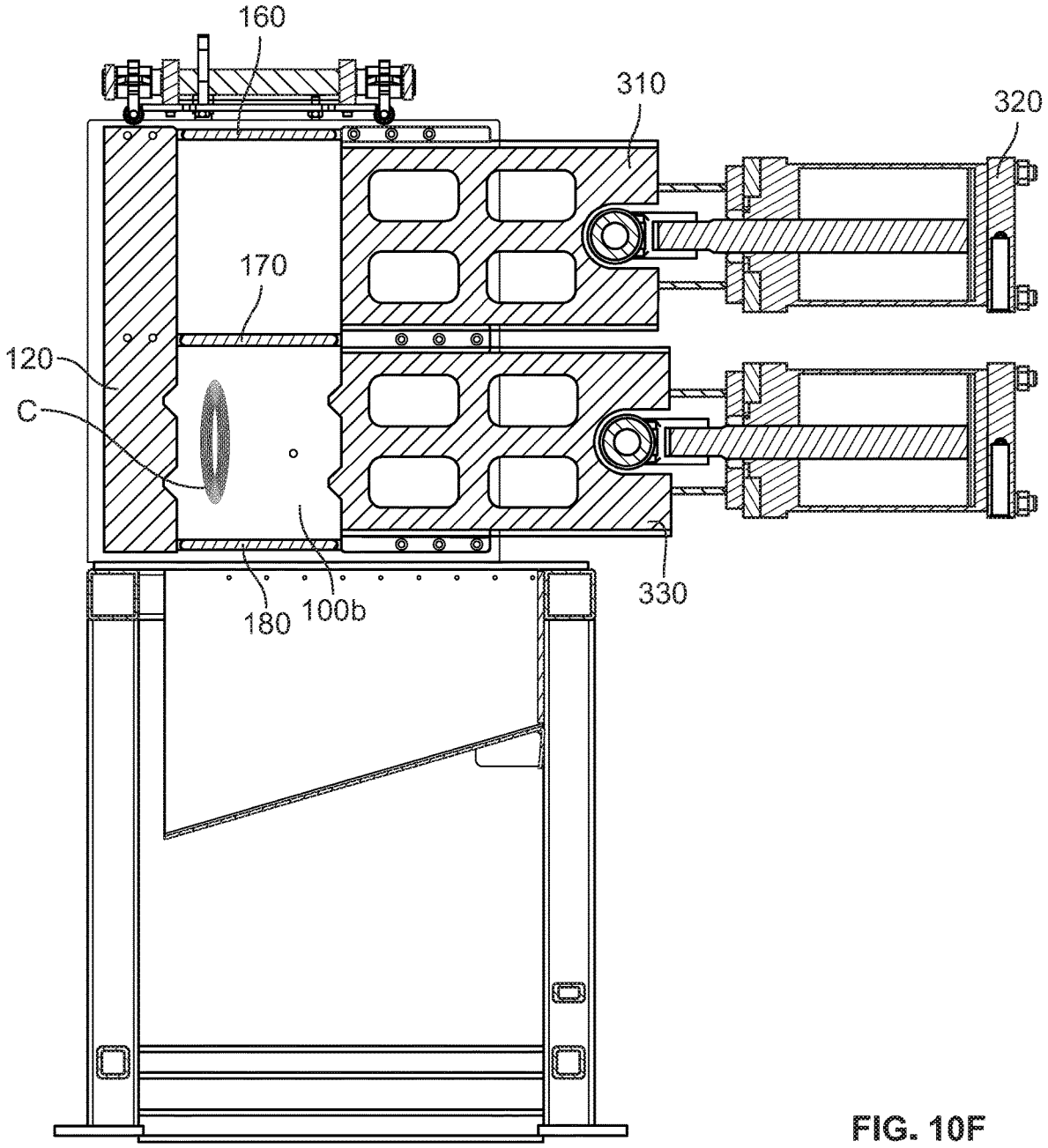
Figure 10G:
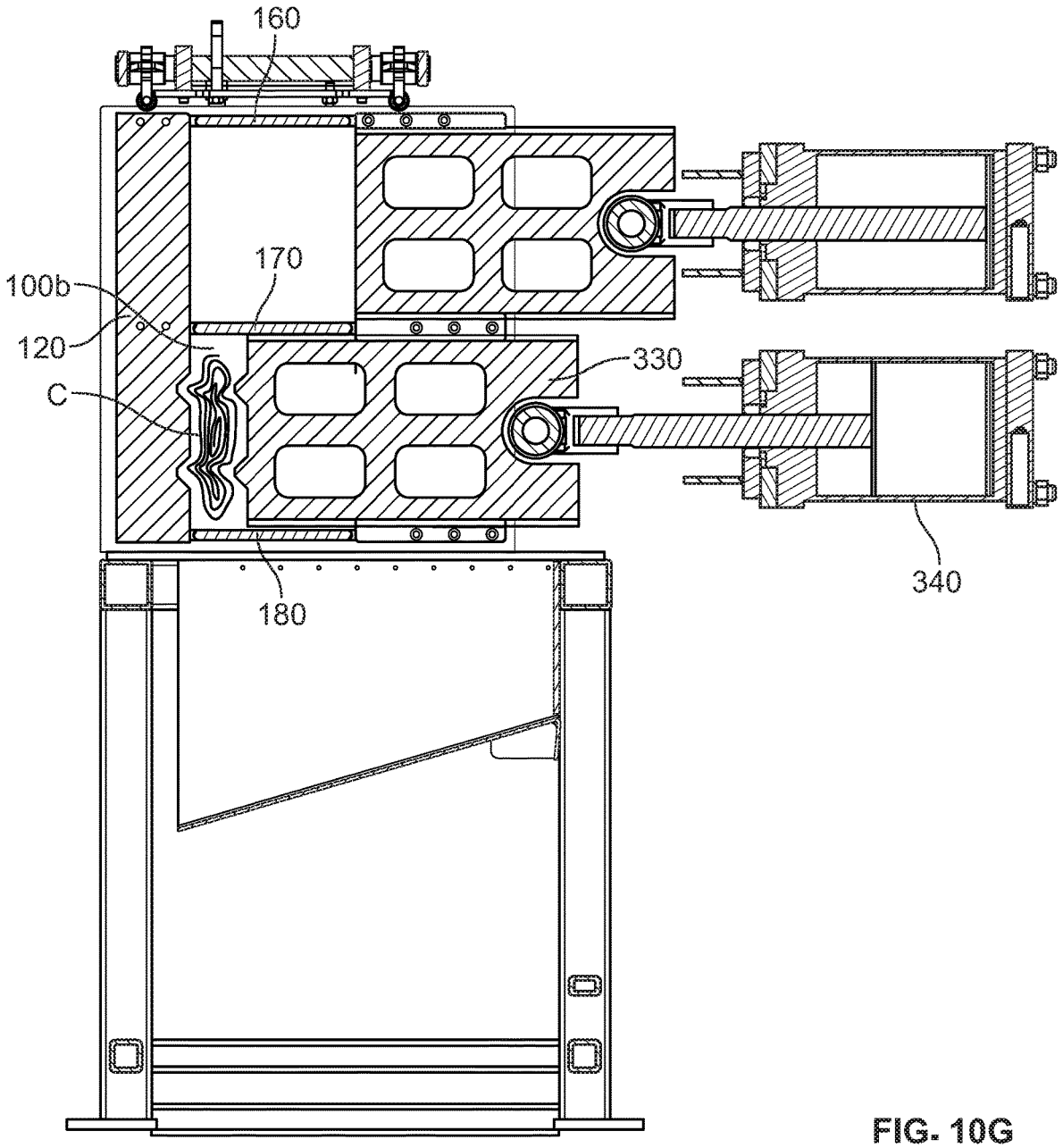

The upper and middle gates open to enable the deformed strap coil to fall out of the first deforming chamber and onto the closed bottom gate, as block 818 indicates, and the upper and middle gates close to enclose the deformed strap coil in the second deforming chamber, as block 820 indicates. Continuing with the above example, the controller 900 controls the first deformer actuator 320 to move the first deformer from its deforming position to its retracted position and also controls the first gate actuator 191 to move the first (upper) and second (middle) gates from their respective closed positions to their respective open positions. As this occurs, the deformed strap coil C falls out of the first deforming chamber 100*a* and into the second deforming chamber 100*b* before coming to a stop atop the third (lower) gate 180. The controller 900 controls the first gate actuator 191 to move the first (upper) and second (middle) gates 160 and 170 from their respective open positions to their respective closed positions to enclose the deformed strap coil in the second deforming chamber 100*b*, as shown in FIG. 10F.

The second deformer further deforms the deformed strap coil, as block 822 indicates. Continuing with the above example, the controller 900 controls the second deformer actuator 340 to move the second deformer 330 from its retracted position to its deforming position. As the second deformer 330 moves, its second deforming surface 330*a* contacts the deformed strap coil C and forces the deformed strap coil C against the second deforming surface 120*b* of the backstop 120. Continued movement of the first deformer 310 causes the projections 330*al* and 330*a*2 of the second deforming surface 330*a* to form notches in the deformed strap coil C. These notches further deform the deformed strap coil C and cause it to further resist uncoiling. Thus, in this example embodiment: the first deformer causes a first type of deformation by deforming the strap coil into an oblong shape, and the second deformer causes a second, different type of deformation by forming notches into the oblong strap coil.

Figure 10H:
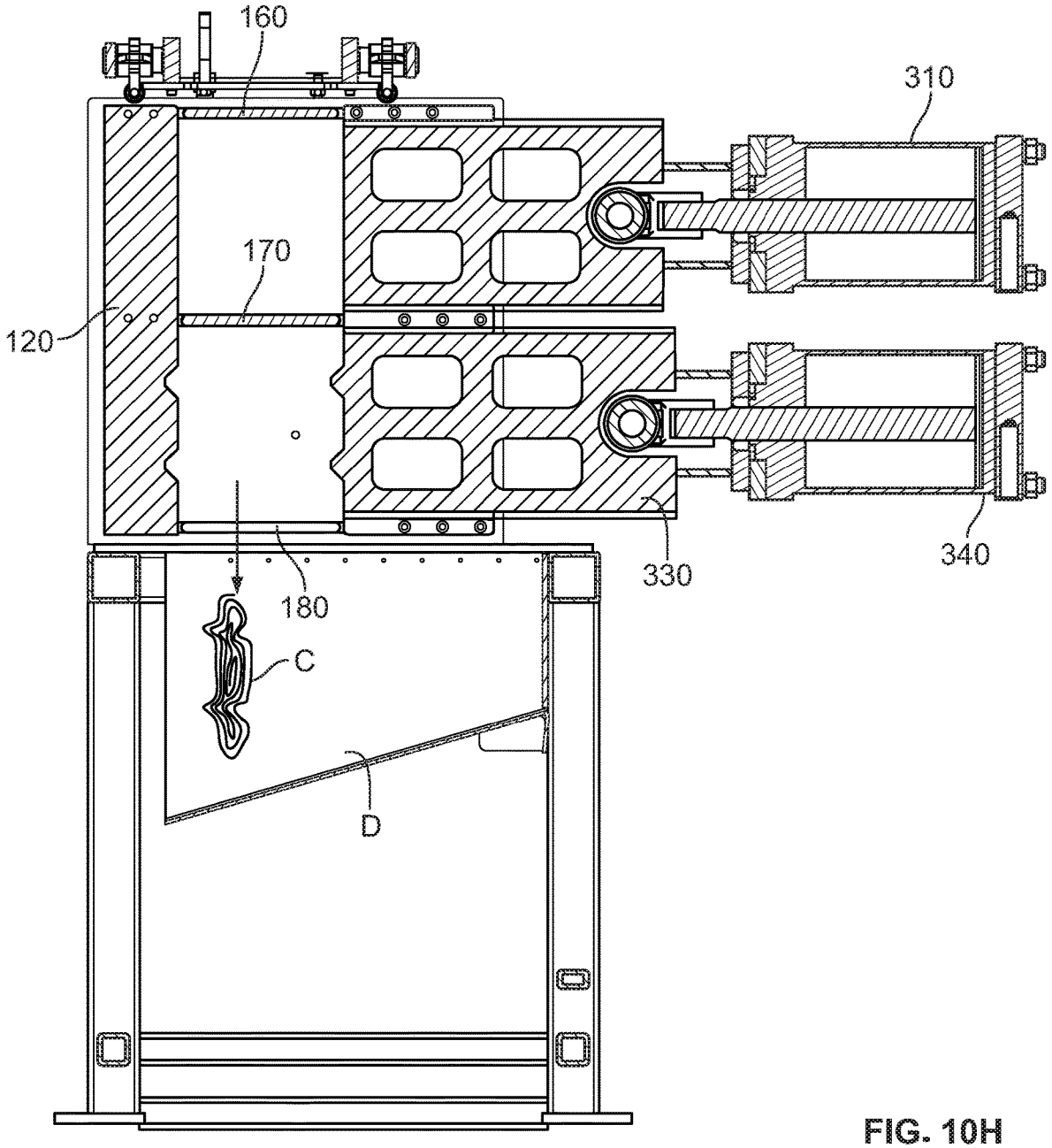

The bottom gate opens to enable the deformed strap coil to fall out of the second deforming chamber and into the discharge chute, as block 824 indicates. Continuing with the above example, the controller 900 controls the second deformer actuator 340 to move the second deformer 330 from its deforming position to its retracted position and controls the second gate actuator 192 to move the third (lower) gate 180 from its closed position to its open position. This enables the deformed strap coil C to fall out of the second deforming chamber 100*b* and into the discharge chute DC, as shown in FIG. 10H. In preparation for carrying out the next winding and deforming process, the upper and middle gates open, the bottom gate closes, and the winding assembly moves to its collecting position, as block 826 indicates. Continuing with the above example, the controller 900 controls the first gate actuator 191 to move the first (upper) and second (middle) gates from their respective closed positions to their respective open positions, controls the second gate actuator 192 to move the third (lower) gate from its open position to its closed position, controls the first winder actuator 490*a* to move the winding-assembly carriage 410 from its winding position to its collecting position. If necessary, the controller 900 also controls the third winder actuator 490*c* to rotate the winding head 460 to its home position.

For clarity, during the winding and deforming process: the first (upper), second (middle), and third (lower) gates and the winding-head carriage move back and forth in a first direction (the Z-direction in the above example embodiment); the first and second deformers move back and forth in a second direction (the X-direction in the above example embodiment); and the winding-assembly carriage moves back and forth in a third direction (the Y-direction in the above example embodiment). The first, second, and third directions are transverse to (and in the above example embodiment, perpendicular to) one another. The first (upper), second (middle), and third (lower) gates are movable relative to the winding-head carriage, the first and second deformers, and the winding-assembly carriage. The winding-head carriage is movable relative to the first (upper), second (middle), and third (lower) gates; the first and second deformers; and the winding-assembly carriage. The first and second deformers are movable relative to the first (upper), second (middle), and third (lower) gates; the winding-assembly carriage; and the winding-head carriage. The winding-assembly carriage is movable relative to the first (upper), second (middle), and third (lower) gates; the winding-head carriage; and the first and second deformers.

In the embodiment of the deforming assembly described above and shown in the Figures, the deforming assembly includes two deformers. In other embodiments, the deforming assembly includes first and second upper deformers and first and second lower deformers. First and second upper deformer actuators are operably connected to the first and second upper deformers, respectively, to control movement of the first and second upper deformers. Similarly, first and second lower deformer actuators are operably connected to the first and second lower deformers, respectively, to control movement of the first and second lower deformers. In these embodiments, the system does not include a backstop. Rather, the first deforming chamber is defined by the first (upper) and second (middle) gates, the first and second upper deformers, and the first and second containment walls. Similarly, the second deforming chamber is defined by the second (middle) and third (lower) gates, the first and second lower deformers, and the first and second containment walls. In these embodiments, to deform the strap coil in the first deforming chamber, the first and second upper deformer actuators control the first and second upper deformers to move toward one another to engage and deform the strap coil. Similarly, to deform the deformed strap coil in the second deforming chamber, the first and second lower deformer actuators control the first and second lower deformers to move toward one another to engage and deform the strap coil.

In the embodiment of the deforming assembly described above and shown in the Figures, the winding assembly winds the strap segment into a coil within the first deforming chamber. In other embodiments, the winding assembly winds the strap segment into a coil outside of or partially inside of the first deforming chamber and then moves the strap coil into the first deforming chamber in preparation for deforming.

In certain embodiments, both deformers include projections, while in other embodiments neither deformer includes projections.

Figure 11:
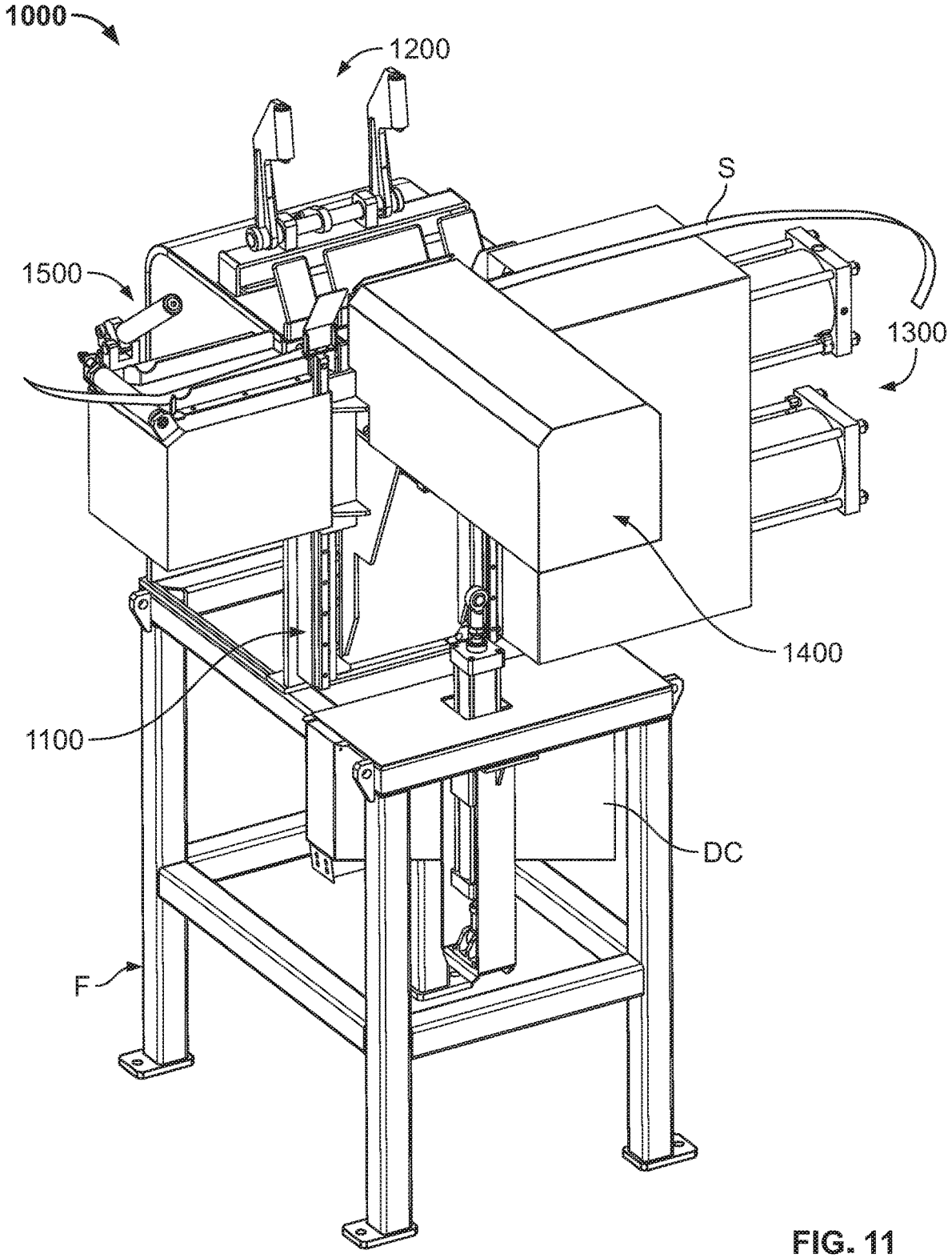
FIG. 11 is a perspective view of another example embodiment of a strap-winding and strap-coil-deforming system of the present disclosure.

FIG. 11 shows another example embodiment of a strap-winding and strap-coil-deforming system 1000 (sometimes referred to below as the "system 1000" for brevity) of the present disclosure and components thereof. The system 1000 is similar to the system 10, and includes a frame F, a housing (not labeled), a discharge chute DC, multiple strap guides (not labeled), a gate assembly 1100, a clamping assembly 1200, a deforming assembly 1300, a winding assembly 1400, a straightening assembly 1500, and a controller 1900 (not shown). The coordinate system shown in FIG. 1 is used as a frame of reference for directional movement of various components of the system 1000 in the X-, Y-, and Z-directions (which are perpendicular to one another in this example embodiment).

The frame F, the housing H, the strap guides G, and the discharge chute DC are similar to (or the same as) those described above with respect to the system 10 and are thus not separately described here. The gate assembly 1100, the clamping assembly 1200, and the deforming assembly 1300 are similar to the gate assembly 100, the clamping assembly 200, and the deforming assembly 300 described above with respect to the system 10 and are thus not separately described here. Components of the gate assembly 1100, the clamping assembly 1200, and the deforming assembly 1300 are identified below with the same numbering convention used for their counterparts in the gate assembly 100, the clamping assembly 200, and the deforming assembly 300 with the addition of a "1" before the element number. For instance, the first gate actuator of the gate assembly 1100 is identified as element number 1191.

Figure 12A:
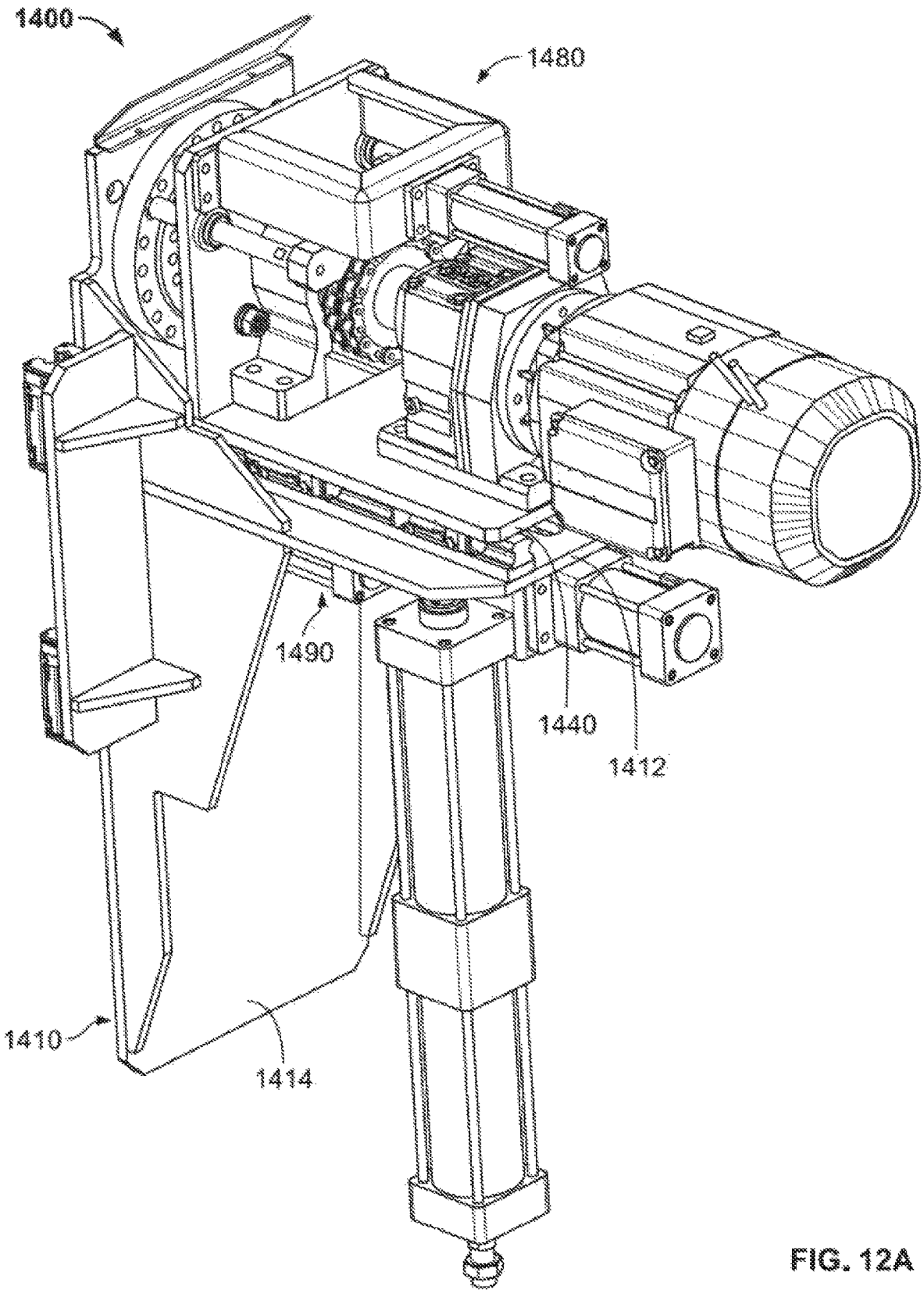
FIGS. 12A-12C are perspective views of the winding assembly of the strap-winding and strap-coil-deforming system of FIG. 11 with certain components removed.
Figure 12B:
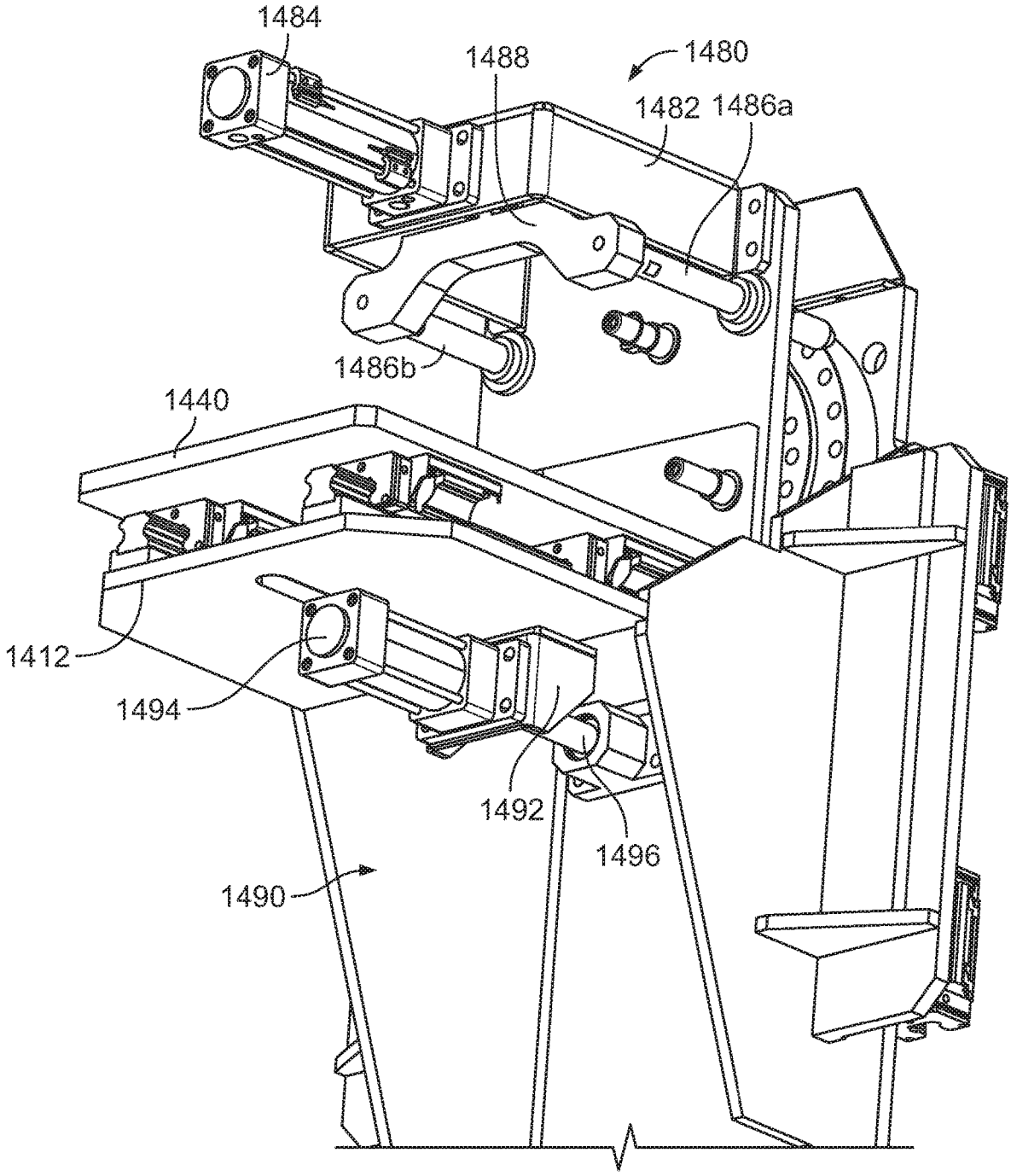
Figure 12C:
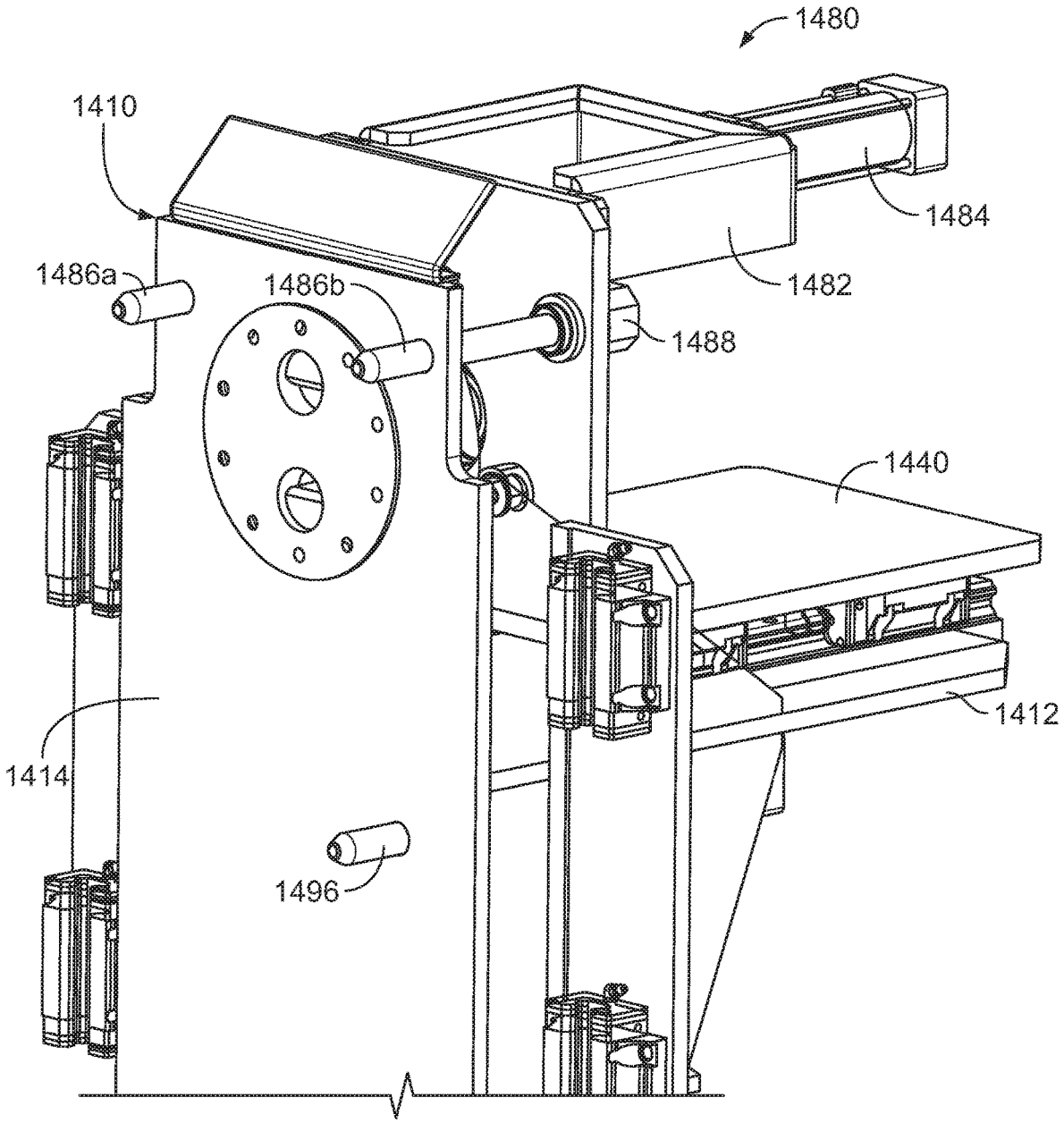

The winding assembly 1400 is best shown in FIGS. 12A-12C and is similar to the winding assembly 400 described above with respect to the system 10 with the addition of a first (upper) ejecting assembly 1480 and a second (lower) ejecting assembly 1490. The first (upper) and second (lower) ejecting assemblies 1480 and 1490 are described in detail below, but for brevity the other components of the winding assembly 1400 that are similar (or identical) to those of the winding assembly 400 are not again described, and many are not shown in FIGS. 12B and 12C for clarity. These other components of the winding assembly 1400 are identified below with the same numbering convention used for their counterparts in the winding assembly 400 with the addition of a "1" before the element number. For instance, the first winder actuator of the winding assembly 1400 is identified as element number 1490*a*.

The first (upper) ejecting assembly 1480 helps move the deformed strap coil from the first deforming chamber 1100*a* to the second deforming chamber 1100*b* (if needed). As best shown in FIGS. 12B and 12C, the first (upper) ejecting assembly 1480 includes: a first (upper) ejecting assembly mount 1482, a first (upper) ejecting assembly actuator 1484, a first ejecting finger 1486*a*, a second ejecting finger 1486*b*, and an ejecting finger support 1488. The first (upper) ejecting assembly mount 1482, which is a bracket in this example embodiment (but may be any other suitable component in other embodiments), is attached to and movable with the winding-head carriage 1440. The first (upper) ejecting assembly actuator 1484, which is a pneumatic cylinder in this example embodiment (but may be any other suitable actuator, such as a hydraulic cylinder or an electric motor, in other embodiments), is attached to the first (upper) ejecting assembly mount 1482. The first and second ejecting fingers 1486*a* and 1486*b*, which are pins in this example embodiment (but may be any other suitable components in other embodiments), are fixedly attached in a spaced-apart manner to the ejecting finger support 1488, which is a plate in this example embodiment (but may be any other suitable component in other embodiments).

The first (upper) ejecting assembly actuator 1484 is operably connected to the ejecting finger support 1488 and configured to move the ejecting finger support 1488 and the first and second ejecting fingers 1486*a* and 1486*b* attached thereto in the Z-direction between a retracted position (FIGS. 12A and 12B) and an ejecting position (FIG. 12C). As the first and second ejecting fingers 1486*a* and 1486*b* move between their retracted and ejecting positions, they move through openings (not labeled) defined through the winding-head carriage 1440 and through openings (not labeled) defined through the second containment wall 1414 of the winding-assembly carriage 1410. As best shown in FIG. 12B, when the first and second ejecting fingers 1486*a* and 1486*b* are in their retracted positions, they are removed from the openings defined through the second containment wall 1414. As best shown in FIG. 12C, when the first and second ejecting fingers 1486*a* and 1486*b* are in their ejecting positions, they extend through and project from the openings defined through the second containment wall 1414.

The second (lower) ejecting assembly 1490 helps move the deformed strap coil from the second deforming chamber 1100*b* to the discharge chute DC (if needed). As best shown in FIGS. 12B and 12C, the second (lower) ejecting assembly 1490 includes: a second (lower) ejecting assembly mount 1492, a second (lower) ejecting assembly actuator 1494, and a third ejecting finger 1496. The second (lower) ejecting assembly mount 1492, which is a bracket in this example embodiment (but may be any other suitable component in other embodiments), is attached to and movable with the winding head support 1412. The second (lower) ejecting assembly actuator 1494, which is a pneumatic cylinder in this example embodiment (but may be any other suitable actuator, such as a hydraulic cylinder or an electric motor, in other embodiments) is attached to the second (lower) ejecting assembly mount 1492.

The second (lower) ejecting assembly actuator 1494 is operably connected to the third ejecting finger 1496, which is a pin in this example embodiment (but may be any other suitable component in other embodiments), and configured to move the third ejecting finger 1496 in the Z-direction between a retracted position (FIGS. 12A and 12B) and an ejecting position (FIG. 12C). As the third ejecting finger 1496 moves between its retracted and ejecting positions, it moves through an opening (not labeled) defined through the second containment wall 1414 of the winding-assembly carriage 1410. As best shown in FIG. 12B, when the third ejecting finger 1496 is in its retracted position, it is removed from the opening defined through the second containment wall 1414. As best shown in FIG. 12C, when the third ejecting finger 1496 is in its ejecting position, it extends through and projects from the opening defined through the second containment wall 1414.

Figure 13:
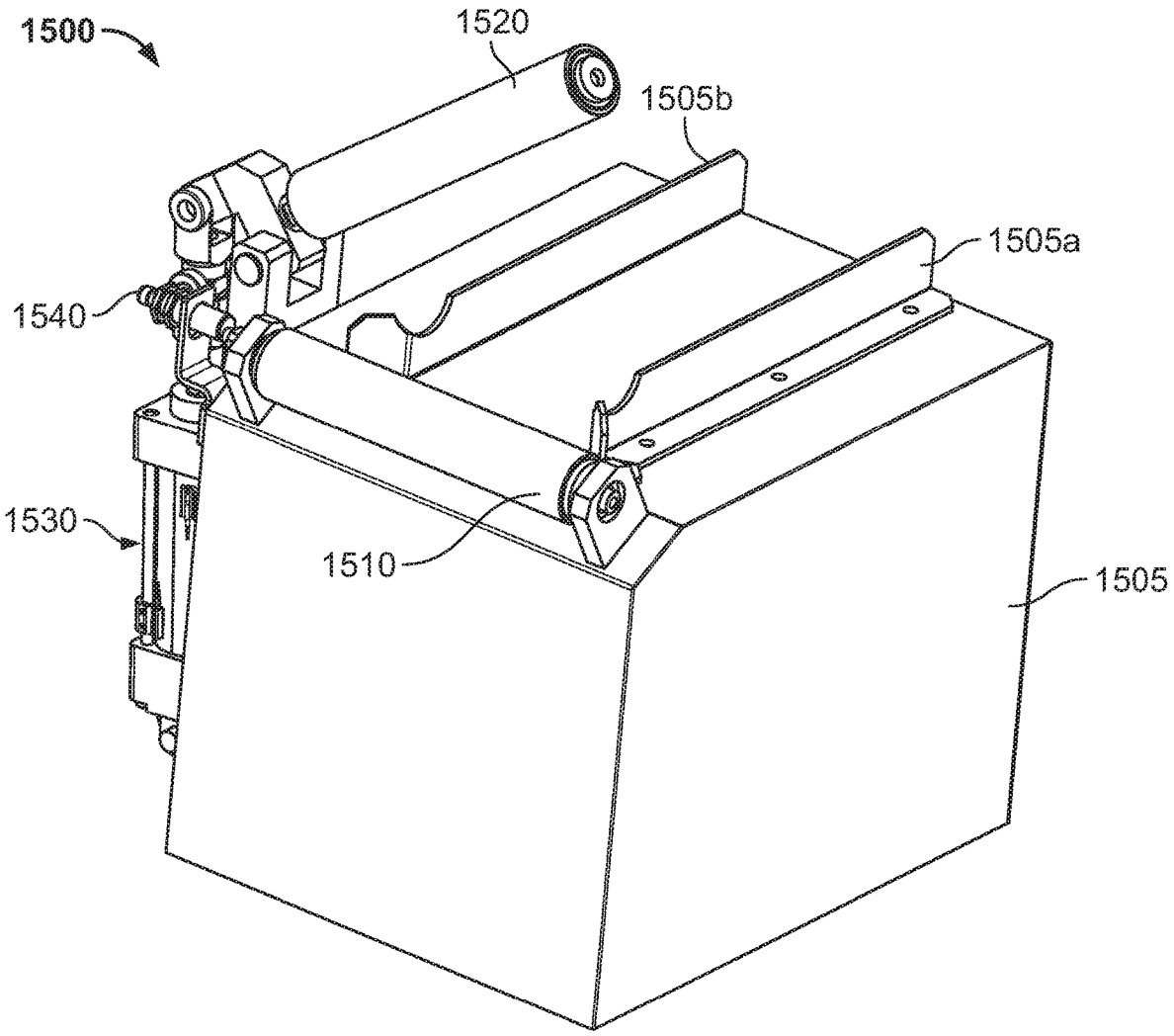
FIG. 13 is a perspective view of the strap-straightening assembly of the strap-winding and strap-coil-deforming system of FIG. 11.

The straightening assembly 1500, which is shown in FIGS. 11 and 13, straightens the strap segment and signals the controller 1900 when to stop winding the strap segment. The straightening assembly 1500 includes a straightening-assembly support 1505, first and second walls 1505*a* and 1505*b*, a first roller 1510, a second roller 1520, a straightening-assembly actuator 1530, and a sensor 1540. As best shown in FIG. 11, the straightening-assembly support 1505 is attached to the housing H such that the gate assembly 1100 and the clamping assembly 1200 generally separate the straightening assembly 1500 and the deforming assembly 1300. The first and second walls 1505*a* and 1505*b* extend in the Y-direction from an upper surface of the straightening-assembly support 1505, are spaced-apart from one another, and in part define the strap-receiving channel SC therebetween. The first roller 1510 is fixedly mounted to and freely rotatable relative to the straightening-assembly support 1505. The second roller 1520 is pivotable relative to the straightening-assembly support 1505 between an open position (FIG. 13) adjacent the first roller 1510 and a closed position (not shown) generally parallel to and adjacent the first roller 1510. The second roller 1520 is freely rotatable relative to the straightening-assembly support 1505. The straightening-assembly actuator 1530, which is a pneumatic cylinder in this example embodiment (but may be any other suitable actuator, such as a hydraulic cylinder or an electric motor, in other embodiments), is operably connected to the second roller 1520 and configured to move the second roller 1520 between its open and closed positions. The sensor 1540 is configured to detect rotation of the first roller 1510 and to generate and send corresponding signals to the controller 1900.

Operation of the system 1000 to carry out a strap-winding and strap-coil-deforming process for a strap segment S is now described. Initially: the first (upper) gate 1160 and the second (middle) gate 1170 of the gate assembly 1100 are in their respective open positions; the third (lower) gate 1180 of the gate assembly 1100 is in its closed position; the first and second strap clamps 1240 and 1250 of the clamping assembly 1200 are in their respective strap-insertion positions; the first and second deformers 1310 and 1330 of the deforming assembly 1300 are in their respective retracted positions; the winding-assembly carriage 1410 is in its collecting position; the winding-head carriage 1440 is in its retracted position; the winding head 1460 is in its home (rotational) position, the first, second, and third ejecting fingers 1486*a*, 1486*b*, and 1496 are in their retracted positions; and the second roller 1520 is in its open position.

After part of a strap segment is positioned in the strap-receiving channel SC of the strap-winding and strap-coil-deforming system 1000, the controller 1900 controls: (1) the clamp actuator 1260 to move the first and second strap clamps 1240 and 1250 from their respective strap-insertion positions to their respective strap-clamp positions; and (2) the straightening-assembly actuator 1530 to move the second roller 1520 to its closed position. As the first and second strap clamps 1240 and 1250 reach their respective strap-clamp positions, the roller 1244 of the first strap clamp 1240 forces part of the strap segment S onto the clamping surface of the backstop 1120, and the roller 1254 of the second strap clamp 1250 forces another part of the strap segment S onto the clamping surface of the first (upper) deformer guide 1130*a* to hold the strap segment S in place. And as the second roller 1520 reaches its closed position, it forces the strap segment S against the first roller 1510, pinching it between the first and second rollers.

The controller 1900 controls the second winder actuator 1490*b* to move the winding-head carriage 1440 from its retracted position to its winding position such that the first and second winding fingers 1464 and 1466 of the winding head 1460 flank part of the strap segment S that extends between the first and second strap clamps 1240 and 1250. The controller 1900 controls the first winder actuator 1490*a* to move the winding-assembly carriage 1410 from its collecting position to its winding position. As this occurs, the underside of the first winding finger 1464 contacts the strap segment S and pulls the strap segment S downward with the winding head 1460. The rollers 1244 and 1254 of the first and second strap clamps 1240 and 1250 enable the winding head 1460 to pull the strap segment S with it while the strap clamps maintain clamping pressure on the strap segment S. The controller 1900 controls the first gate actuator 1191 to move the first (upper) and second (middle) gates 1160 and 1170 from their respective open positions to their respective closed positions. This encloses the portions of the first and second winding fingers 1464 and 1466 projecting from the winding-assembly carriage 1410 and part of the strap segment S in the first deforming chamber 1100*a*.

The controller 1900 controls the third winder actuator 1490*c* to rotate the winding head 1460. As this occurs, the remainder of the strap segment S is pulled through the rollers 1510 and 1520 of the strap-straightening assembly 1500, into the first deforming chamber 1100*a*, and wound into a strap coil C. As the strap segment moves between the rollers 1510 and 1520, they remove (or lessen) any curl in the strap segment to facilitate winding into the coil. Additionally, as the strap segment moves between the rollers 1510 and 1520, it causes the rollers to rotate, and the sensor 1540 detects this rotation. Once the strap segment S has been completely wound into the strap coil, it no longer contacts the rollers 1510 and 1520, and the rollers stop rotating. The sensor 1540 detects this and generates and sends a corresponding signal to the controller 1900. In response to receiving this signal, the controller 1900 controls the third winder actuator 1490*c* to stop rotating the winding head 1640. The controller 1900 controls the second winder actuator 1490*b* to move the winding-head carriage 1440 from its winding position to its retracted position such that the first and second winding fingers 1464 and 1466 are removed from the first deforming chamber 1100*a* (and no longer contact the strap coil C).

The controller 1900 controls the first deformer actuator 1320 to move the first deformer 1310 from its retracted position to its deforming position. As the first deformer 1310 moves, its first deforming surface 1310*a* contacts the strap coil C and forces the strap coil C against the first deforming surface 1120*a* of the backstop 1120. Continued movement of the first deformer 1310 causes the first deformer 1310 to deform the strap coil C into an oblong shape.

The controller 1900 controls the first deformer actuator 1320 to move the first deformer from its deforming position to its retracted position and also controls the first gate actuator 1191 to move the first (upper) and second (middle) gates from their respective closed positions to their respective open positions. As this occurs, in most cases the deformed strap coil C falls out of the first deforming chamber 1100*a* and into the second deforming chamber 1100*b* before coming to a stop atop the third (lower) gate 1180. But in certain instances the deformed strap coil C becomes stuck in the first deforming chamber 1100*a* or between the first and second deforming chambers 1100*a* and 1100*b*. To ensure the deformed strap coil C reaches the second deforming chamber 1100*b*, the controller 1900 controls the first winder actuator 1490*a* to move the winding-assembly carriage 1410 from its winding position to its collecting position (or another position above the winding position). The controller 1900 controls the first (upper) ejecting assembly actuator 1484 to move the first and second ejecting fingers 1486*a* and 1486*b* from their retracted positions to their ejecting positions. The controller 1900 then controls the first winder actuator 1490*a* to move the winding-assembly carriage 1410 from its collecting position toward the second deforming chamber 1100*b*. As this occurs, if the deformed strap coil C is stuck one or both of the first and second ejecting fingers 1486*a* and 1486*b* contact and force the deformed strap coil C to move into the second deforming chamber 1100*b*. The controller 1900 then controls the first (upper) ejecting assembly actuator 1484 to move the first and second ejecting fingers 1486*a* and 1486*b* from their ejecting positions to their retracted positions and the first winder actuator 1490*a* to move the winding-assembly carriage 1410 back to its collecting position.

The controller 1900 controls the first gate actuator 1191 to move the first (upper) and second (middle) gates 1160 and 1170 from their respective open positions to their respective closed positions to enclose the deformed strap coil in the second deforming chamber 1100*b*. The controller 1900 controls the second deformer actuator 1340 to move the second deformer 1330 from its retracted position to its deforming position. As the second deformer 1330 moves, its second deforming surface 1330*a* contacts the deformed strap coil C and forces the deformed strap coil C against the second deforming surface 1120*b* of the backstop 1120. Continued movement of the first deformer 1310 causes the projections 1330*a*1 and 1330*a*2 of the second deforming surface 1330*a* to form notches in the deformed strap coil C. These notches further deform the deformed strap coil C and cause it to further resist uncoiling. Thus, in this example embodiment: the first deformer causes a first type of deformation by deforming the strap coil into an oblong shape, and the second deformer causes a second, different type of deformation by forming notches into the oblong strap coil.

The controller 1900 controls the second deformer actuator 1340 to move the second deformer 1330 from its deforming position to its retracted position and controls the second gate actuator 1192 to move the third (lower) gate 1180 from its closed position to its open position. This enables the deformed strap coil C to fall out of the second deforming chamber 1100*b* and into the discharge chute DC. But in certain instances the deformed strap coil C becomes stuck in the second deforming chamber 1100*b* or between the second deforming chamber 1100*b* and the discharge chute DC. To ensure the deformed strap coil C reaches the discharge chute DC, the controller 1900 controls the second (lower) ejecting assembly actuator 1494 to move the third ejecting finger 1496 from its retracted position to its ejecting position. The controller 1900 then controls the first winder actuator 1490*a* to move the winding-assembly carriage 1410 from its collecting position toward the discharge chute DC. As this occurs, if the deformed strap coil C is stuck the third ejecting finger 1496 contacts and forces the deformed strap coil C to move into the discharge chute DC. The controller 1900 then controls the second (lower) ejecting assembly actuator 1494 to move the third ejecting finger 1496 from its ejecting position to its retracted position and the first winder actuator 1490*a* to move the winding-assembly carriage 1410 back to its collecting position.

The invention claimed is:

1. A strap-winding and strap-coil-deforming system comprising:

a containment wall;

a first gate movable between a first open position and a first closed position;

a second gate movable between a second open position and a second closed position;

a third gate movable between a third open position and a third closed position;

a first deformer comprising a first deforming surface and movable between a first retracted position and a first deforming position;

a second deformer comprising a second deforming surface and movable between a second retracted position and a second deforming position; and a winding assembly comprising a winding-assembly carriage supporting a rotatable winding head comprising multiple winding fingers, wherein the winding-assembly carriage is movable between a collecting position and a winding position, wherein the winding head is movable between a retracted position and a winding position, wherein the containment wall, the first and second gates, and the first deforming surface of the first deformer at least partially define a first deforming chamber, wherein the containment wall, the second and third gates, and the second deforming wall of the second deformer at least partially define a second deforming chamber.

2. The strap-winding and strap-coil-deforming system of claim 1, wherein the winding-assembly carriage at least partially defines the first and second deforming chambers.

3. The strap-winding and strap-coil-deforming system of claim 1, wherein the first gate is movable in a first direction between the first open position and the first closed position, wherein the second gate is movable in the first direction between the second open position and the second closed position, wherein the third gate is movable in the first direction between the third open position and the third closed position, wherein the first deformer is movable in a second direction between the first retracted position and the first deforming position, wherein the second deformer is movable in the second direction between the second retracted position and the second deforming position, wherein the winding assembly is movable in a third direction between the collecting position and the winding position.

4. The strap-winding and strap-coil-deforming system of claim 3, wherein the winding head is movable in the first direction between the retracted position and the winding position.

5. The strap-winding and strap-coil-deforming system of claim 4, wherein the first, second, and third directions are transverse to one another.

6. The strap-winding and strap-coil-deforming system of claim 4, wherein the first, second, and third gates are movable relative to the containment wall, the first and second deformers, and the winding assembly, wherein the first and second deformers are movable relative to the winding assembly, and wherein the winding head is movable relative to the winding-assembly carriage.

7. The strap-winding and strap-coil-deforming system of claim 1, wherein the winding fingers of the winding head are in the first deforming chamber when the winding assembly and the winding head are in their respective winding positions, wherein the winding fingers are removed from the first deforming chamber when the winding assembly is in its winding position and the winding head is in its retracted position.

8. The strap-winding and strap-coil-deforming system of claim 1, further comprising a backstop comprising first and second deforming surfaces, wherein the first and second deforming surfaces of the backstop partially define the first and second deforming chambers, respectively.

9. The strap-winding and strap-coil-deforming system of claim 8, wherein movement of the first deformer from the first retracted position to the first deforming position causes the first deforming surface of the first deformer to move toward the first deforming surface of the backstop, wherein movement of the second deformer from the second retracted position to the second deforming position causes the second deforming surface of the second deformer to move toward the second deforming surface of the backstop.

10. The strap-winding and strap-coil-deforming system of claim 9, wherein one of: (1) the second deforming surface of the second deformer; and (2) the second deforming surface of the backstop comprises a projection.

11. The strap-winding and strap-coil-deforming system of claim 10, wherein the other of: (1) the second deforming surface of the second deformer; and (2) the second deforming surface of the backstop comprises an indentation sized to receive the projection.

12. The strap-winding and strap-coil-deforming system of claim 9, wherein the first gate is movable in a first direction between the first open position and the first closed position, wherein the second gate is movable in the first direction between the second open position and the second closed position, wherein the third gate is movable in the first direction between the third open position and the third closed position, wherein the first deformer is movable in a second direction between the first retracted position and the first deforming position, wherein the second deformer is movable in the second direction between the second retracted position and the second deforming position, wherein the winding assembly is movable in a third direction between the collecting position and the winding position.

13. The strap-winding and strap-coil-deforming system of claim 12, further comprising:

one or more gate actuators operably connected to the first, second, and third gates and configured to control movement of: (a) the first gate between the first open position and the first closed position, (b) the second gate between the second open position and the second closed position, and (c) the third gate between the third open position and the third closed position;

one or more deformer actuators operably connected to the first and second deformers and configured to control movement of: (a) the first deformer between the first open position and the first closed position, and (b) the second deformer between the second open position and the second closed position;

a first winder actuator operably connected to the winding-assembly carriage and configured to control movement of the winding-assembly carriage between the collecting position and the winding position;

a second winder actuator operably connected to the winding head and configured to control movement of the winding head between the retracted position and the winding position; and a third winder actuator operably connected to the winding head and configured to rotate the winding head.

14. The strap-winding and strap-coil-deforming system of claim 13, wherein the winding head is movable in the first direction between the retracted position and the winding position.

15. The strap-winding and strap-coil-deforming system of claim 13, wherein the first, second, and third directions are transverse to one another.

16. The strap-winding and strap-coil-deforming system of claim 1, wherein the winding assembly comprises an ejecting assembly comprising an ejecting finger movable between a retracted position and an ejecting position.

17. A strap-winding and strap-coil-deforming process comprising:

rotating a winding head to wind a strap segment into a coil;

deforming the strap coil in a first deforming chamber; and further deforming the strap coil in a second deforming chamber separate from the first deforming chamber.

18. The strap-winding and strap-coil-deforming process of claim 17, further comprising, before rotating the winding head to wind the strap segment, engaging the strap segment with the winding head and moving part of the strap segment into the first deforming chamber.

19. The strap-winding and strap-coil-deforming process of claim 18, further comprising clamping the strap segment via at least one strap clamp and, thereafter, engaging the strap segment with the winding head.

20. The strap-winding and strap-coil-deforming process of claim 19, further comprising:

before rotating the winding head to wind the strap segment, closing first and second gates to enclose the part of the strap segment in the first deforming chamber; and after deforming the strap coil in the first deforming chamber, opening the second gate to enable the deformed strap coil to fall into the second deforming chamber.

* * * * *